US005203678A

United States Patent [19]

Sugiyama et al.

[11] Patent Number: 5,203,678

[45] Date of Patent: Apr. 20, 1993

[54] VALVE APPARATUS AND HYDRAULIC DRIVE SYSTEM

[75] Inventors: Genroku Sugiyama, Ibaraki; Toichi Hirata, Ushiku; Yusuke Kajita, Tsuchiura, all of Japan

[73] Assignee: Hitachi Construction Machinery Co., Ltd., Tokyo, Japan

[21] Appl. No.: 655,368

[22] PCT Filed: Nov. 1, 1990

[86] PCT No.: PCT/JP90/01407

§ 371 Date: Feb. 28, 1991

§ 102(e) Date: Feb. 28, 1991

[87] PCT Pub. No.: WO91/10833

PCT Pub. Date: Jul. 25, 1991

[30] Foreign Application Priority Data

Jan. 11, 1990 [JP] Japan ..... 2-2539

[51] Int. Cl.[5] ..... F04B 1/26

[52] U.S. Cl. ..... 417/218; 91/446; 137/596.13; 251/285; 60/452

[58] Field of Search ..... 60/452, 450; 137/596.13; 251/285; 91/446; 417/218

[56] References Cited

U.S. PATENT DOCUMENTS

| | | | |
|---|---|---|---|
| 3,856,436 | 12/1974 | Lonnemo | 60/450 X |
| 4,167,893 | 9/1979 | Johnson | 91/446 |
| 4,336,687 | 6/1982 | Morgan | 60/452 X |
| 4,428,400 | 1/1984 | Tantardini | 137/596.13 X |
| 4,457,341 | 7/1984 | Aspinwall | 251/285 |
| 4,515,181 | 5/1985 | Dezelan | 60/452 X |
| 4,617,798 | 10/1986 | Krusche et al. | 60/450 |
| 4,738,279 | 4/1988 | Kropp | 60/452 |
| 4,781,219 | 11/1988 | Haarstad et al. | 137/596.13 X |
| 4,914,913 | 4/1990 | Germain et al. | 60/450 |
| 4,981,159 | 1/1991 | Christensen et al. | 91/446 X |
| 5,025,625 | 6/1991 | Morikawa | 137/596.13 X |
| 5,038,671 | 8/1991 | Ueno | 137/596.13 X |

FOREIGN PATENT DOCUMENTS

| | | |
|---|---|---|
| 61-88002 | 5/1986 | Japan . |
| 61-252902 | 11/1986 | Japan . |
| 61-266801 | 11/1986 | Japan . |
| 2195745 | 4/1988 | United Kingdom . |

*Primary Examiner*—Leonard E. Smith

*Attorney, Agent, or Firm*—Fay, Sharpe, Beall, Fagan, Minnich & McKee

[57] ABSTRACT

A valve apparatus has a flow control valve having a supply passage communicating with a hydraulic fluid supply source, a load passage communicating with an actuator, and a first meter-in variable restrictor disposed between the supply passage and the load passage and opened dependent on an operation amount there; a first signal passage located downstream of the first variable restrictor and having a passage section for detecting load pressure of the actuator; a tank passage communicating with a reservoir tank; a discharge passage for communicating the first signal passage with the tank passage; and a second variable restrictor provided in the discharge passage and having its opening variable dependent on the operation amount of the flow control valve to produce in the first signal passage a control pressure different from the load pressure, the control pressure in the first signal passage being led to the hydraulic fluid supply source though a second signal passage. An auxiliary restrictor is disposed in the first signal passage to reduce the load pressure detected in the passage section of the first signal passage so that a pressure lower than the detected load pressure is produced in the first signal passage as the control pressure.

15 Claims, 14 Drawing Sheets

VALVE APPARATUS AND HYDRAULIC DRIVE SYSTEM

TECHNICAL FIELD

The present invention relates to a valve apparatus for use in a hydraulic drive system for civil engineering and construction machines such as hydraulic excavators and cranes, as well as a hydraulic drive system equipped with the valve apparatus, and more particularly to a valve apparatus for use in a hydraulic drive system including a hydraulic fluid supply source which has a supply pressure control function such as a load sensing system, and also a hydraulic drive system for the valve apparatus.

BACKGROUND ART

In a hydraulic drive system for civil engineering and construction machines such as hydraulic excavators and cranes, a flow of a hydraulic fluid supplied from a hydraulic fluid supply source to an actuator is controlled by a valve apparatus including a flow control valve.

This type hydraulic drive system uses, as a hydraulic fluid supply source, means for controlling the supply pressure to be held higher a fixed value than the load pressure of the actuator. As disclosed in GB 2195745A, one example of such means is a pump regulator which implements a load sensing system for controlling the pump delivery rate such that the delivery pressure of a hydraulic pump is higher a fixed value than the load pressure. Because the hydraulic fluid is supplied with the load sensing system just at a flow rate required by the actuator, undesired supply of the hydraulic fluid is reduced, which is advantageous in economy. On the other hand, the load sensing system also has the shortcoming that the pump delivery pressure cannot be controlled after the intention of an operator because of its dependency on the load pressure. Therefore, when an inertial load such as a swing of hydraulic excavators is turned, the pump delivery pressure increases up to the setting pressure of a main relief valve irrespective of the amount of a flow control valve operated. This raises the problem that an acceleration of the inertial load is maximized and the operator suffers from a large shock.

A known one of valve apparatus for use in the hydraulic drive system implementing the above load sensing system is disclosed in JP, A, 61-88002. This disclosed valve apparatus comprises a flow control valve having a supply passage communicating with a hydraulic fluid supply source, a load passage communicating with an actuator, and a first meter-in variable restrictor disposed between the supply passage and the load passage and opened dependent on an operation amount thereof; a first signal passage branched from the load passage downstream of the first variable restrictor and including a restrictor and a check valve allowing a hydraulic fluid to flow toward the load passage; a tank passage communicating with a reservoir tank; a discharge passage for communicating the first signal passage with the tank passage; a second variable restrictor provided in the discharge passage and having its opening variable dependent on the operation amount of the flow control valve to produce in the first signal passage a control pressure different from load pressure; and a second signal passage for leading the control pressure in the first signal passage to the hydraulic fluid supply source, the valve apparatus being featured in further comprising a third signal passage for connecting the first signal passage to the upstream side of the first variable restrictor at a point between the check valve and the second variable restrictor, and a restrictor disposed in the third signal passage.

With that valve apparatus, the pressure upstream of the first variable restrictor is reduced by the restrictor in the third signal passage and then led to the first signal passage. Thus, the reduced pressure is led as the control pressure to the hydraulic fluid supply source to perform the load sensing control, so that the pump delivery pressure may be controlled not depending on the load pressure. Also, by adjusting respective openings of the restrictor in the first signal passage, the restrictor in the second signal passage, and the restrictor in the third signal passage into the appropriate relationship, the dependency on the load pressure can be assured to some extent in a range above the predetermined operation amount, so that the flow rate dependent on the operation amount of the flow control valve is obtained.

In the above valve apparatus, however, since the first signal passage is branched from the load passage downstream of the first variable restrictor and includes the restrictor, there occurs a flow of the hydraulic fluid passing from the first signal passage through the restrictor therein to the load passage under a normal condition that the operation amount of the flow control valve is so increased as to secure a predetermined differential pressure across the first variable restrictor. Accordingly, the control pressure which is produced in the first signal passage by reducing the pressure upstream of the first variable restrictor is lower than the pressure upstream of the first variable restrictor, e.g., the pump pressure, but higher than the pressure downstream of the first variable restrictor, i.e., the load pressure. Consequently, the differential pressure between the pressure upstream of the first variable restrictor and the control pressure in the first signal passage becomes smaller than the differential pressure across the first variable restrictor. Thus, if the differential pressure across the first variable restrictor is set to a desired value, the differential pressure between the pressure upstream of the first variable restrictor and the control pressure in the first signal passage would be smaller than the desired value.

The hydraulic fluid supply source for the load sensing system receives, as an input signal, the differential pressure between the delivery pressure of the hydraulic pump and the aforesaid control pressure to thereby control the delivery rate of the hydraulic pump such that the above differential pressure becomes equal to a preset target value. Accordingly, the smaller differential pressure between the pressure upstream of the first variable restrictor and the control pressure in the first signal passage implies that the target value must be set to a smaller one. The reduced target value leads to the problem that the control gain is also reduced and hunting is more likely to occur.

If the differential pressure across the first variable restrictor is set to a larger value, the aforesaid differential pressure as the input signal to the hydraulic fluid supply source for the load sensing system could be increased. But, the larger differential pressure across the first variable restrictor would increase the pressure loss in the first variable restrictor and would be undesirable from the standpoint of economy.

An object of the present invention is to provide a valve apparatus and a hydraulic drive system which can control the pump delivery pressure and the drive pressure of an actuator dependent on the operation amount of a flow control valve, and can increase the differential pressure as an input signal to a load sensing system, when the actuator is driven.

DISCLOSURE OF THE INVENTION

To achieve the above object, the present invention provides a valve apparatus for controlling a flow of a hydraulic fluid supplied from a hydraulic fluid supply source to an actuator, comprising a flow control valve having a supply passage communicating with said hydraulic fluid supply source, a load passage communicating with said actuator, and a first meter-in variable restrictor disposed between said supply passage and said load passage and opened dependent on an operation amount thereof; a first signal passage located downstream of said first variable restrictor and having a passage section for detecting load pressure of said actuator; a tank passage communicating with a reservoir tank; a discharge passage for communicating said first signal passage with said tank passage; and a second variable restrictor provided in said discharge passage and having its opening variable dependent on the operation amount of said flow control valve to produce in said first signal passage a control pressure different from said load pressure, the control pressure in said first signal passage being led to said hydraulic fluid supply source through a second signal passage, wherein said valve apparatus further comprises auxiliary restrictor means disposed in said first signal passage for reducing the load pressure detected in said passage section of said first signal passage so that a pressure lower than the detected load pressure is produced in said first signal passage as said control pressure.

The present invention also provides a hydraulic drive system incorporating the above valve apparatus.

With the present invention thus arranged, since the second variable restrictor having an opening variable dependent on the operation amount of the flow control valve is disposed in the discharge passage, and the auxiliary restrictor means is disposed in the first signal passage, so that the load pressure is adjusted by two restrictors; i.e., the second variable restrictor and the auxiliary restrictor means, to thereby create the control pressure, in the sole operation of the above hydraulic actuator, assuming that the target pressure to be held by the load sensing system implemented with the hydraulic fluid supply source is $\Delta P$, the opening area of the first variable restrictor is A, the opening area of the auxiliary restrictor means is a1, and the opening area of the second variable restrictor is a2, the port pressure of the load passage, i.e., the drive pressure of the hydraulic actuator, is a function of A, al, a2 and $\Delta P$. Because A and a2 are determined dependent on the operation amount of the flow control valve, the drive pressure can be obtained dependent on the operation amount of the flow control valve. Further, because the hydraulic fluid supply source implements the load sensing system, the pump delivery pressure can also be produced dependent on the operation amount of the flow control valve.

In the combined operation of the above hydraulic actuator and other one or more actuators, because a pressure compensating valve for controlling the differential pressure across the first variable restrictor is disposed, the port pressure of the load passage, i.e., the drive pressure of the hydraulic actuator, is a function of A, al, a2 and $\Delta P^*$, assuming that the target pressure to be held by the pressure compensating valve is $\Delta P^*$. As with the above case, the drive pressure and the pump delivery pressure can be both obtained dependent on the operation amount of the flow control valve.

Accordingly, it is possible to carry out the operation as intended by an operator with higher accuracy for providing superior operability, and to control an acceleration of an inertial load driven by the hydraulic actuator for alleviating the shock perceived by the operator.

In addition, with the present invention, since the load pressure is introduced to the first signal passage through the auxiliary restrictor means to create the control pressure, the control pressure is lower than the load pressure, and the differential pressure between the pump delivery pressure and the control pressure is larger than the differential pressure across the first variable restrictor. Therefore, the differential pressure across the first variable restrictor can be set to a normal small value which results in small pressure loss, so that the differential pressure between the pump delivery pressure and the control pressure may be a satisfactorily large value. Consequently, it is possible to increase the control gain of the load sensing system and achieve stable control of the hydraulic pump free from hunting.

BEST MODE FOR CARRYING OUT THE INVENTION

First Embodiment

To begin with, a first embodiment of the present invention will be described below with reference to FIGS. 1 through 4. This embodiment pertains to a hydraulic drive system for driving a single-acting actuator.

Figure 1:
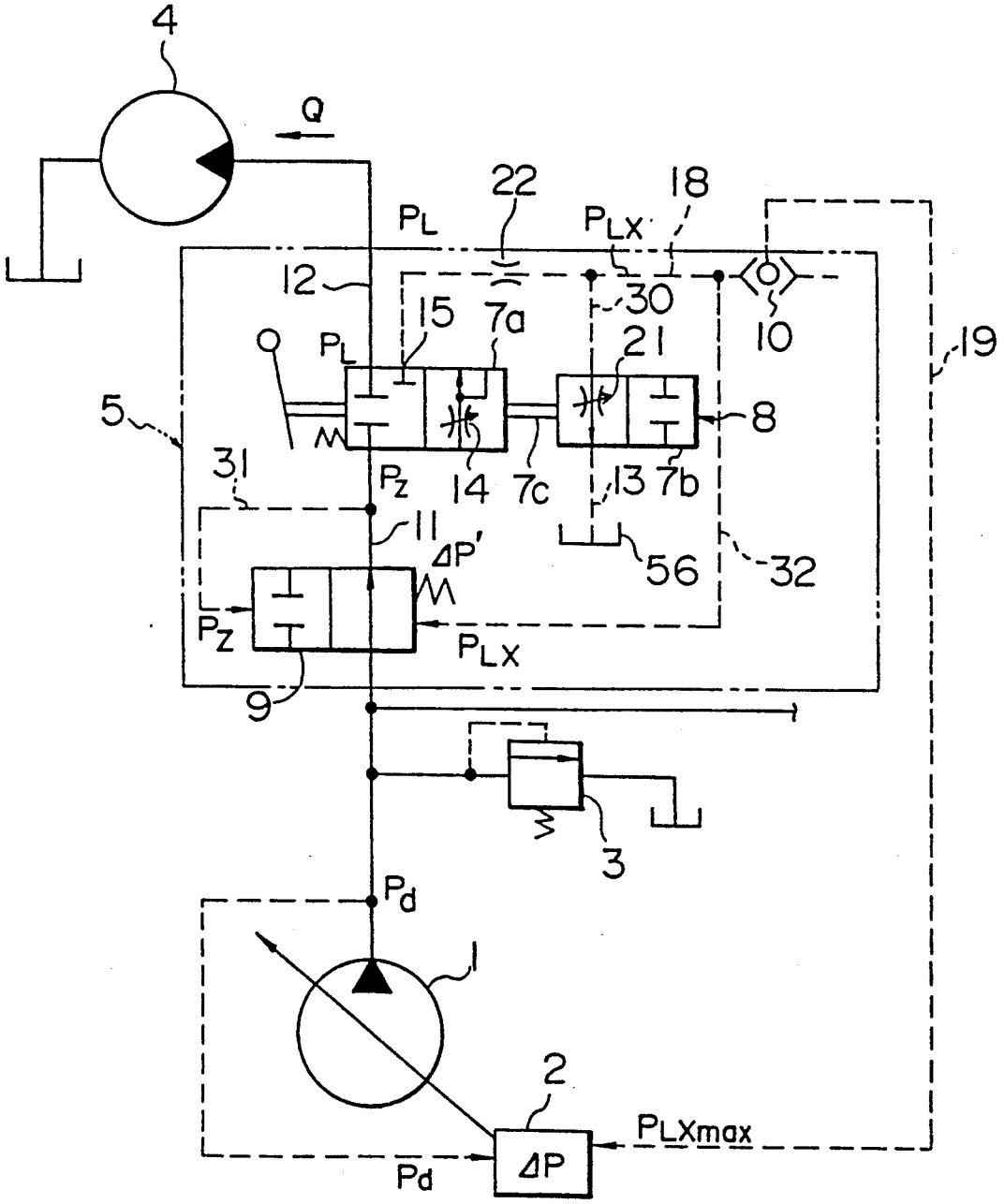
FIG. 1 is a schematic view of a hydraulic drive system incorporating a valve apparatus according to a first embodiment of the present invention.

In FIG. 1, the hydraulic drive system of this embodiment comprises a hydraulic fluid supply source made up by a hydraulic pump 1 of variable displacement type and a pump regulator 2 for controlling the displacement volume of the hydraulic pump 1 and constituting a load sensing system, a main relief valve 3 for setting maximum pressure of a hydraulic fluid delivered from the hydraulic pump 1, a single-acting actuator, e.g., a hydraulic motor 4, driven by the hydraulic fluid delivered from the hydraulic pump 1, and a valve apparatus 5 for controlling a flow of the hydraulic fluid supplied from the hydraulic pump 1 to the hydraulic motor 4.

The pump regulator 2 controls the displacement volume of the hydraulic pump 1 such that a differential pressure Pd−PLXmax between a delivery pressure Pd of the hydraulic pump 1 and a later-described maximum control pressure PLXmax, or a differential pressure Pd−PLX between the pump (delivery) pressure Pd and a later-described control pressure PLX associated with the hydraulic motor 4 in the case of sole operation of the hydraulic motor 4, is balanced with preset pressure ΔP. In other words, the delivery rate of the hydraulic pump 1 is controlled so as to keep the relationship of Pd=PLXmax+ΔP.

Figure 2:
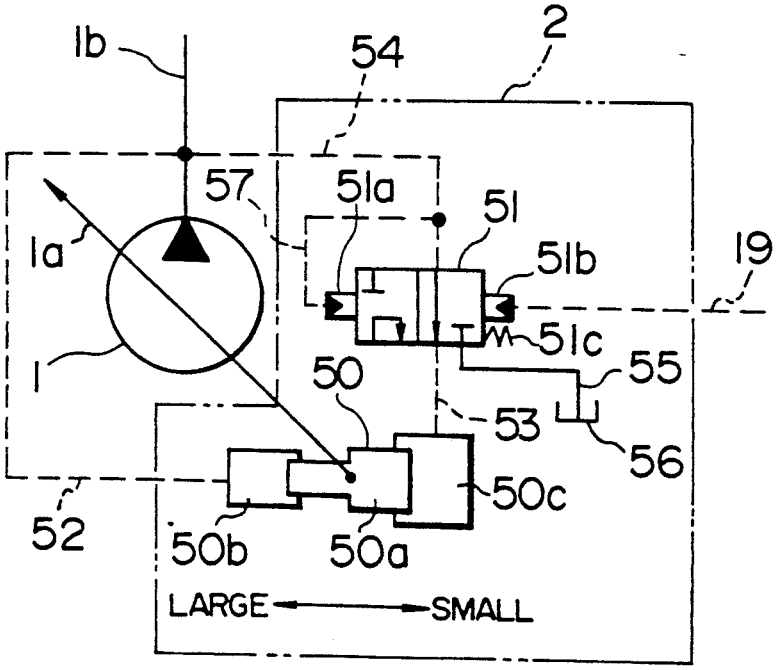
FIG. 2 is a detailed view of a pump regulator used in the hydraulic drive system of FIG. 1.

The pump regulator 2 is detailed in FIG. 2. The pump regulator 2 comprises an actuator 50 operatively coupled to a swash plate 1*a* of the hydraulic pump 1 for controlling the displacement volume of the hydraulic pump 1, and a regulating valve 51 operated in response to the differential pressure Pd−PLXmax between the pump pressure Pd and the maximum control pressure PLXmax for controlling operation of the actuator 50. The actuator 50 comprises a double-acting cylinder having a piston 50*a* having opposite end faces of different pressure receiving areas from each other, and a small-diameter cylinder chamber 50*b* and a large-diameter cylinder chamber 50*c* positioned to receive the opposite end faces of the piston 50*a*, respectively. The small-diameter cylinder chamber 50*b* is communicated with a delivery line 1*b* of the hydraulic pump 1 through a line 52, whereas the large-diameter cylinder chamber 50*c* is selectively communicated with the delivery line 1*b* through a line 53, the regulating valve 51 and a line 54, or with a reservoir tank 56 through the line 53, the regulating valve 51 and a line 55. The regulating valve 51 has two drive parts 51*a*, 51*b* in opposite relation. The pump pressure Pd is loaded to one drive part 51*a* through a line 57 and the line 54, whereas the maximum control pressure PLXmax is loaded to the other drive part 51*b* through a signal line 19 as a second signal passage described later. A spring 51*c* is also disposed in the regulating valve 51 on the same side as the driver part 51*b*.

As the maximum control pressure PLXmax detected by the signal line 19 rises, the regulating valve 51 is shifted leftwardly on the drawing to take an illustrated position. In this state, the large-diameter cylinder chamber 50*c* of the actuator 50 is communicated with the delivery line 1*b*, whereupon the piston 50*a* is moved leftwardly on the drawing because of the difference in pressure receiving area between the opposite end faces of the piston 50*a* to increase the tilting amount of the swash plate 1*a*, i.e., the displacement volume of the hydraulic pump 1. As a result, the pump delivery rate is increased to raise the pump pressure Pd. With the pump pressure Pd raised, the regulating valve 51 is returned back rightwardly on the drawing. When the differential pressure Pd−PLXmax reaches a target value determined by the spring 51*c*, the regulating valve 51 is stopped and the pump delivery rate is kept constant. On the contrary, as the maximum control pressure PLXmax lowers, the regulating valve 51 is shifted rightwardly on the drawing. At this shift position, the large-diameter cylinder chamber 50*c* of the actuator 50 is communicated with the reservoir tank 56, whereupon the piston 50*a* is moved rightwardly on the drawing to decrease the tilting amount of the swash plate 1*a*. As a result, the pump delivery rate is decreased to lower the pump pressure Pd. With the pump pressure Pd lowered, the regulating valve 51 is returned back leftwardly on the drawing. When the differential pressure Pd−PLXmax reaches the target value determined by the spring 51*c*, the regulating valve 51 is stopped and the pump delivery rate is kept constant. In this manner, the pump delivery rate is controlled such that the differential pressure Pd−PLXmax is held at the target differential pressure determined by the spring 51*c*.

Returning to FIG. 1, the valve apparatus 5 comprises a flow control valve 8 for controlling a flow rate of the hydraulic fluid supplied to the hydraulic motor 4, a pressure compensating valve 9 disposed upstream of the flow control valve 8 for controlling the differential pressure across the flow control valve 8 to supply the hydraulic fluid at a substantially constant flow rate irrespective of fluctuations in the load pressure PL of the hydraulic motor 4 and the pump pressure Pd during the combined operation, a supply passage 11 communicating with the pump 1 through the pressure compensating valve 9, and a load passage 12 capable of communicating with the supply passage 11 and connected to the hydraulic motor 4. The flow control valve 8 comprises a spool made up of a spool section 7*a*, a spool section 7*b* and a rod 7*c* integrally formed together. The spool section 7*a* has formed therein a first meter-in variable restrictor 14 having an opening variable dependent on the operation amount of the flow control valve 8, i.e., the spool stroke, to disconnect or connect between the supply passage 11 and the load passage 12, and a detection port 15 opened downstream of the first variable restrictor 14 for fluid communication with the load passage 12 to detect the load pressure of the hydraulic motor 4.

The valve apparatus 5 also comprises a first signal passage (hereinafter simply referred to as a signal passage) 18 communicating with the detection port 15, a shuttle valve 10 disposed downstream of the signal passage 18, a discharge passage 30 branched from the signal passage 18, and a tank passage 13 communicating with the reservoir tank 56. The spool section 7*b* of the flow control valve 8 has formed therein a second variable restrictor 21 having an opening variable dependent on the spool stroke to connect or disconnect between the discharge passage 11 and the tank passage 13. The second variable restrictor 21 is configured such that it is opened with a predetermined opening when the flow control valve 8 is in a neutral position, and is closed after opening of the first variable restrictor 14 when the operation amount of the flow control valve 8, i.e., the spool stroke, increases. Further, the signal passage 18 has a fixed restrictor 22 as auxiliary restrictor means disposed between the detection port 15 and the point where the discharge passage 30 is branched from the signal passage 18.

The second variable restrictor 21 and the fixed restrictor 22 jointly serve to adjust the load pressure detected by the detection port 15 for creating the control pressure PLK in the signal passage 18. When the second variable restrictor 21 is open, a small amount of the hydraulic fluid flows from the detection port 15 to the tank passage 13 through the signal passage 18 and the discharge passage 30. The load pressure detected by the detection port 15 is reduced by the second variable restrictor 21 and the fixed restrictor 22 so that the control pressure PLK lower than the load pressure PL is produced downstream of the fixed restrictor 22 in the signal passage 18. When the second variable restrictor 21 is closed, there occurs no such a flow of the hydraulic fluid thereby to create the control pressure PLK equal to the load pressure.

The shuttle valve 10 serves as higher-pressure selector means for selecting maximum one of control pressures including the control pressure PLK. The selected maximum control pressure PLXmax is passed to a signal line 19 as a second signal passage so that the pump regulator 2 is controlled to regulate the displacement volume of the hydraulic pump 1 for implementation of the load sensing load sensing system, as mentioned above.

The valve apparatus 5 further comprises passages 31, 32 for leading inlet pressure Pz of the first variable restrictor 14 and the control pressure PLK to the pressure compensating valve 9, respectively. The pressure compensating valve 9 operates so as to hold differential pressure Pz−PLK between the inlet pressure Pz of the first variable restrictor 14 and the control pressure PLX at substantially constant differential pressure $\Delta P^*$. As a result, the differential pressure across the flow control valve 8 is controlled to an almost fixed value.

Figure 3:
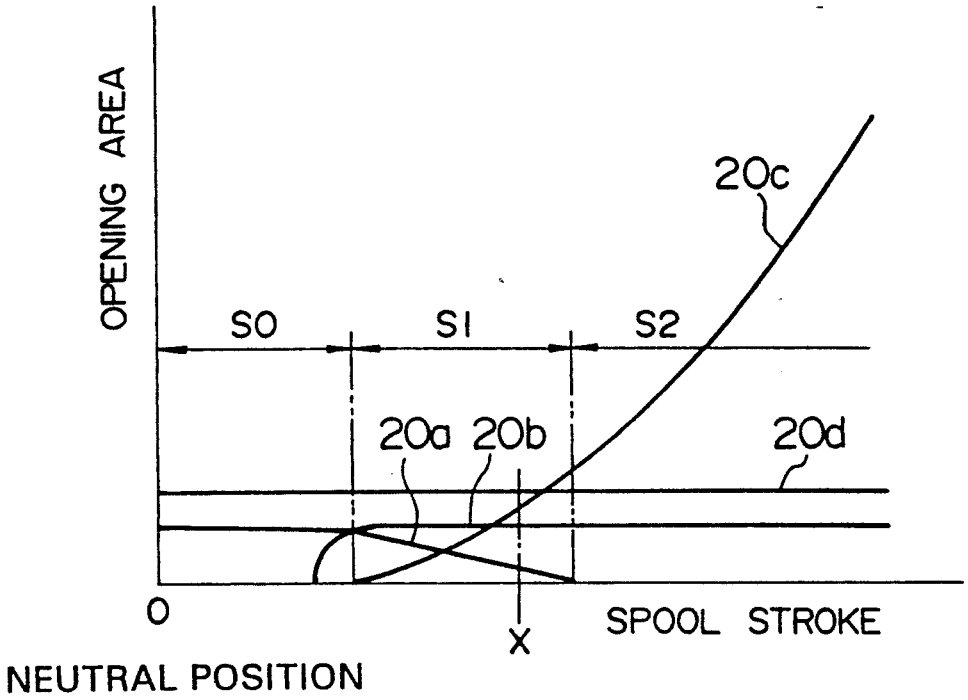
FIG. 3 is a characteristic view showing the relationships between the spool stroke of a flow control valve and the opening areas of a first variable restrictor, a second variable restrictor and a fixed restrictor as developed in the first embodiment.

Shift timing of the first and second variable restrictors 14, 21 of the flow control valve 8 and the detection port 15 with respect to the spool stroke, as taken place when the spool of the flow control valve 8 is moved from a neutral position leftwardly in FIG. 1 in the above-described valve apparatus 5, will now be explained with reference to a characteristic graph of FIG. 3 showing the relationship between the spool stroke and the respective opening areas. In FIG. 3, a characteristic line 20*a* represents the opening area of the second variable restrictor 21, a characteristic line 20*b* represents the opening area between the detection port 15 and the load passage 12, and a characteristic line 20*c* represents the opening area of the first meter-in variable restrictor 14. In addition, a characteristic line 20*d* represents characteristics of the fixed restrictor 22.

First, as seen from the characteristic line 20*a* in FIG. 3, when the spool of the flow control valve 8 is in a neutral position, the second variable restrictor 21 is open with a predetermined opening, and the control pressure in the signal passage 18 is equal to the tank pressure. When the spool of the flow control valve 8 is moved rightwardly on the drawing from the above condition, the detection port 15 opens to communicate with the load passage 12 so that the load pressure PL of the hydraulic motor 4 shown in FIG. 1 is led to the detection port 15, as seen from the characteristic line 20*b* in FIG. 3. In this condition, the second variable restrictor 21 is still open.

When the spool of the flow control valve 8 is further moved rightwardly, the first meter-in variable restrictor 14 now opens, whereupon the hydraulic fluid supplied through the pressure compensating valve 9 from the hydraulic pump 1 shown in FIG. 1 is introduced to the hydraulic motor 4 through the supply passage 11, the first variable restrictor 14 and the load passage 12 shown in FIG. 1. As seen from the characteristic line 20*a*, at the time when the first variable restrictor 14 opens, the second variable restrictor 21 still remains opened, but its opening area has started decreasing. Afterward, the opening area of the first variable restrictor 14 is gradually increased with an increase in the spool stroke, whereas the opening area of the second variable restrictor 21 is gradually decreased. Consequently, downstream of the fixed restrictor 22 in the signal passage 18 shown of FIG. 1, the detected pressure is adjusted by the fixed restrictor 22 and the second variable restrictor 21 to create the control pressure PLX lower than the load pressure PL. The control pressure PLX is passed to the regulating valve 51 (see FIG. 2) of the pump regulator 2 through the shuttle valve 10 and the signal line 19 shown in FIG. 3, as mentioned above, whereby the pump 1 is controlled such that the delivery pressure Pd is raised up to a value given by $Pd = PLK + \Delta P$. As a result, the delivery pressure Pd of the hydraulic pump 1 and the port pressure of the load passage 12, i.e., the drive pressure (=load pressure) PL of the hydraulic motor 4 can be controlled as described later.

When the spool is further moved from the above condition, the second variable restrictor 21 is closed as seen from the characteristic line 20*a* in FIG. 3, and the control pressure PLX equal to the load pressure PL is created in the signal passage 18. This control pressure is passed to the pump regulator 2, whereby the pump 1 is controlled such that the delivery pressure Pd is raised up to a value given by $Pd = PLX + \Delta P$. The hydraulic fluid from the hydraulic pump 1 is supplied to the hydraulic motor 4 through the pressure compensating valve 9, the supply passage 11, the first variable restrictor 14 and the load passage 12 for operating the hydraulic motor 4 to drive a working member (not shown).

Figure 4:
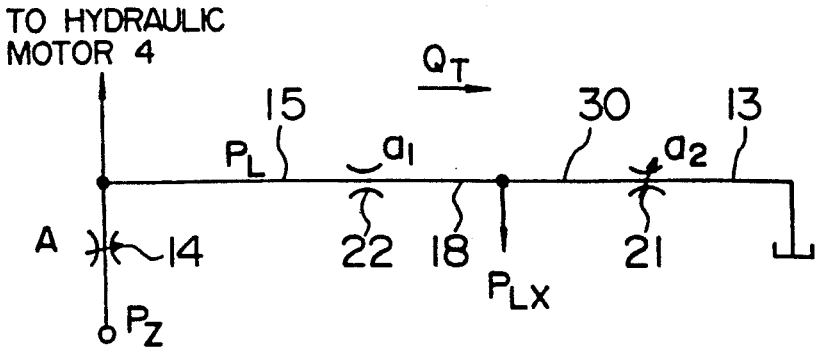
FIG. 4 is a diagram schematically showing a hydraulic system including a signal passage and a discharge passage established in the first embodiment.

Operation in a range of the spool stroke from opening of the first variable restrictor 14 to closing of the second variable restrictor 21, i.e., in a region S1 in FIG. 3, will be explained below. A hydraulic system including the first variable restrictor 14, the detection port 15, the fixed restrictor 22, the signal passage 18, the discharge passage 30, the second variable restrictor 21 and the tank passage 13 can be schematically depicted as shown in FIG. 4.

Supposing now that only the hydraulic motor 4 is driven solely and the pressure compensating valve 9 serving to compensate for the differential pressure $\Delta P^*$ is not operated and is in a full-open state, the supply pressure, i.e., the pump delivery pressure Pd, is equal to the pressure upstream of the first meter-in variable restrictor 14, i.e., the inlet pressure Pz. Also, owing to the presence of the first variable restrictor 14, the fixed restrictor 22 and the second variable restrictor 21 connected in series to the hydraulic fluid flowing out from the tank passage 13 at a flow rate QT, the relationship among the inlet pressure Pz, the port pressure or the load pressure PL, the control pressure LX and the tank pressure PT is expressed by:

$$Pz > PL > PLX > PT = 0$$

Let it now be assumed that the opening area of the first variable restrictor 14 is A, the opening area of the fixed restrictor 22 is al, the opening area of the second variable restrictor 21 is a2, and the hydraulic motor 4 is in a port-blocked state due to the inertial load of a driven member, the flow rate of the hydraulic fluid passing through the first variable restrictor 14 is also QT and, therefore, the following equations hold:

$$Q_t = C \cdot A \sqrt{Pz - PL} \quad (1)$$

$$QT = C \cdot a1 \sqrt{Pz - PLX} \quad (2)$$

$$QT = C \cdot a2 \sqrt{PLX - PT} \quad (3)$$

$$Pd = Pz = PLX + \Delta P \quad (4)$$

Elimination of QT, etc. from the above equations (1) through (4) leads to:

$$PL = \{A^2(a1^2 + a2^2)/a2^2(a1^2 + A^2)\}\Delta P \quad (5)$$

This can be rewritten to:

$$PL = [\{1 + (a2/a1)^2\}/(a2/a1)^2(a1^2/A^2 + 1)]\Delta P \quad (6)$$

It will be found from the above equation that the value of the port pressure PL is determined from A, ΔP, a1 and a2. It will be also found from the equation (4) that the value of the pump delivery pressure Pd is likewise determined from A, ΔP, a1 and a2.

When the hydraulic motor 4 and other one or more actuators (not shown) are driven simultaneously, the pressure compensating valve 9 is operated to hold the differential pressure between the pressure Pz upstream of the first variable restrictor 14 and the control pressure PLX at the setting value ΔP*. By replacing Pz−PL in the above equation (1) with Pz−PLX and ΔP in the above equation (4) with ΔP*, therefore, the following equation is obtained:

$$PL = \{A^2(a1^2 + a2^2)/a2^2(a1^2 + A^2)\}\Delta P^* \quad (7)$$

Accordingly, it will be found that during the combined operation, the values of the pump delivery pressure Pd and the port pressure PL are also determined from A, ΔP*, a1 and a2.

As will be apparent from the forgoing equations (5) through (7), the drive pressure PL of the hydraulic motor 4, i.e., the port pressure, is a function of the opening areas A and a2 which are determined dependent on the spool stroke of the flow control valve 8. Consequently, in either case of the sole operation of the hydraulic motor 4 or the combined operation of the hydraulic motor 4 and other one or more actuators, there can be obtained the port pressure PL dependent on the operation amount of the flow control valve 8, i.e., the spool stroke.

With the first embodiment thus arranged, the flow rate of the hydraulic fluid can be controlled primarily by the opening area A of the first meter-in variable restrictor 14 and, as seen from the equation (6), the maximum value of the port pressure PL can be controlled by the ratio of the opening area a2 of the second variable restrictor 21 to the opening area a1 of the fixed restrictor 22. Therefore, the pressure control and the flow control both necessary for operation of hydraulic machines can be optimally set by appropriate selection of the opening areas A, a1 and a2.

Accordingly, it is possible to carry out the operation as intended by the operator with higher accuracy for providing superior operability, and to control an acceleration of the inertial load driven by the hydraulic motor 4 for alleviating the shock perceived by the operator.

Further, in this embodiment, since the load pressure PL is introduced to the signal passage through the fixed restrictor 22 to create the control pressure PLX, there exists the relationship of PL>PLX. In the sole operation of the hydraulic motor 4, the pressure compensating valve 9 is fully opened to give Pd=Pz, and the differential pressure ΔP=Pd−PLX between the pump delivery pressure Pd and the control pressure PLX is larger than the differential pressure ΔP*=Pz−PL across the first variable restrictor 14. It is therefore possible to set the differential pressure across the first variable restrictor 14 to a normal small value which results in the reduced pressure loss, while reserving the differential pressure ΔP at a satisfactorily large value.

The regulating valve 51 of the pump regulator 2 receives the differential pressure ΔP between the delivery pressure Pd of the hydraulic pump 1 and the control pressure PLX, as an input signal, to control the delivery rate of the hydraulic pump such that the differential pressure ΔP becomes equal to the fixed value determined by the spring 51*c*. Accordingly, the smaller differential pressure ΔP implies that the spring 51*c* must be set to a small setting value. With the setting value reduced, the control gain is so reduced that hunting is more likely to occur. With this embodiment, the differential pressure ΔP as the input signal of the pump regulator 2 can be set to a large value as mentioned above, it is possible to increase the control gain for enabling stable control of the hydraulic pump 1 free from hunting.

Moreover, in this embodiment, the control pressure PLX is created from the load pressure PL using two restrictors; the fixed restrictor 22 and the second variable restrictor 21. This results in the advantageous effect that the flow rate of the hydraulic fluid passing through the signal passage 18 and the discharge passage 30 to the reservoir tank 56 can be reduced, and the pressure control can be achieved with smaller energy loss.

Although the restrictor 22 is fixed one in the above first embodiment, it may be a variable one whose opening is variable dependent on the spool stroke of the flow control valve 8 as will be understood from the foregoing equations (5) through (7). This modification can further improve control characteristics.

While the spool of the flow control valve 8 comprises the spool sections 7*a*, 7*b* and the rod 7*c* integrally formed together, the rod 7*c* may be made as a separate member. Alternatively, the spool sections 7*a*, 7*b* may be arranged to be movable independently and driven by a common pilot pressure. In addition, either one or both of the first and second variable restrictors 14, 21 may be in the form of a poppet valve.

Second Embodiment

Figure 5:
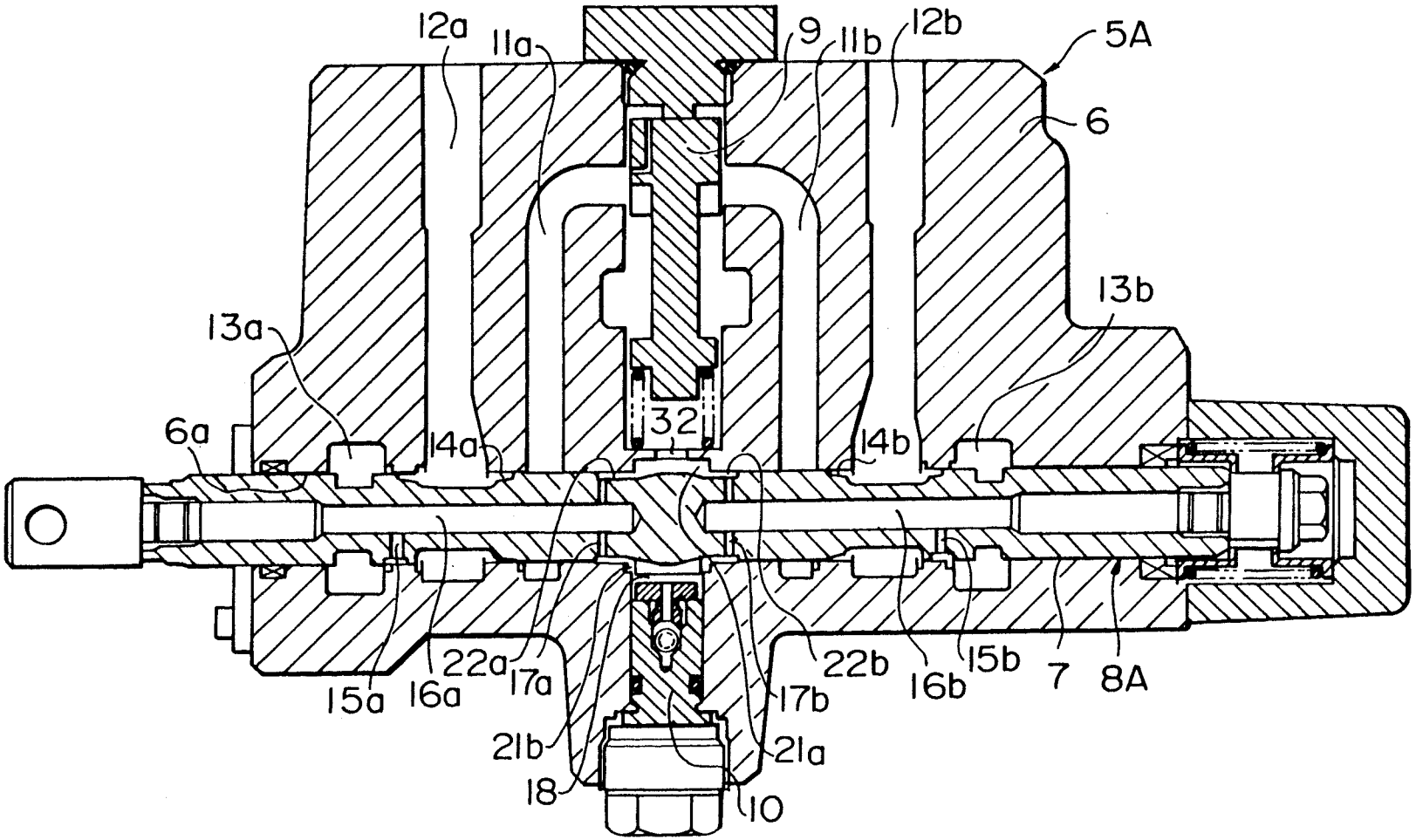
FIG. 5 is a vertical sectional view of a valve apparatus according to a second embodiment of the present invention.
Figure 6:
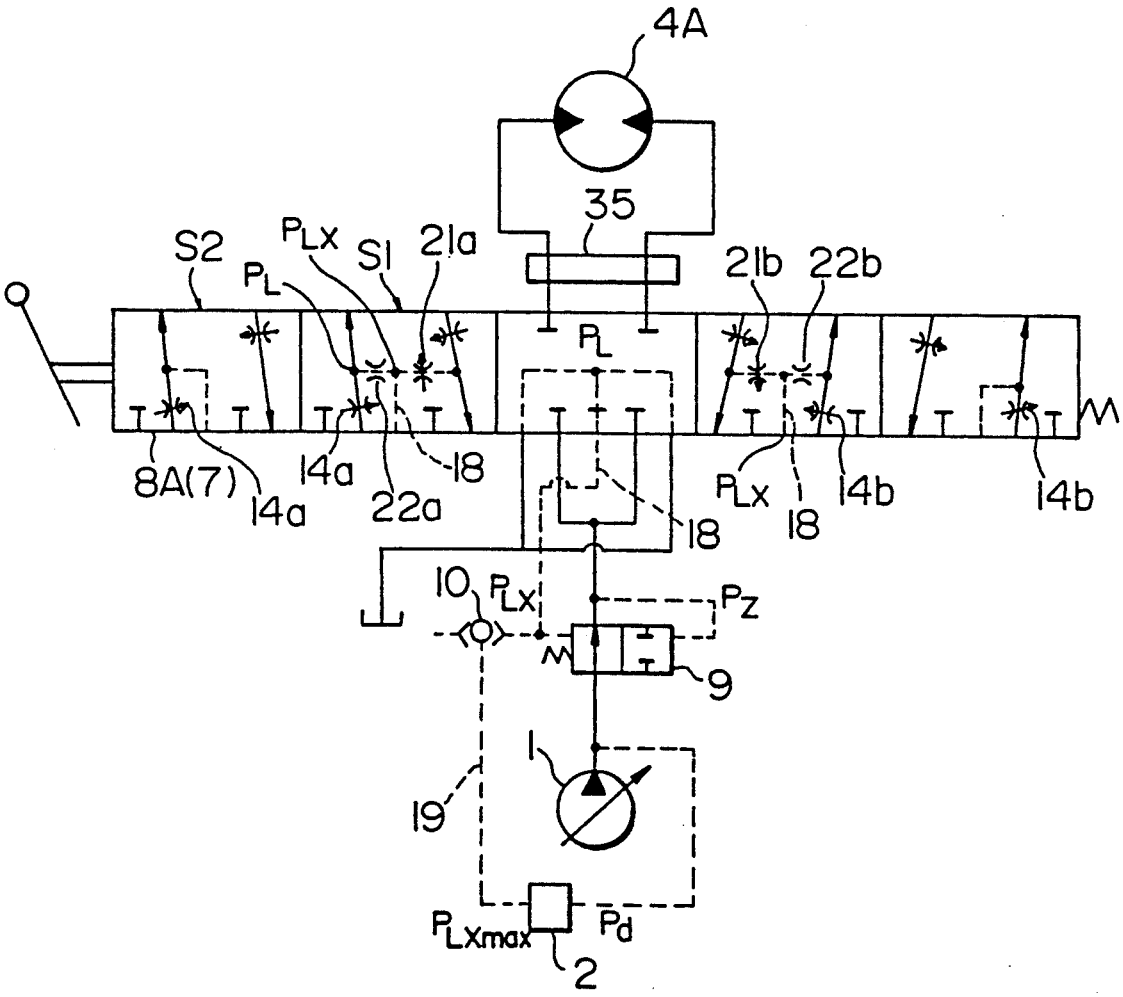
FIG. 6 is a circuit diagram showing the valve apparatus shown in FIG. 5 in terms of function.

A second embodiment of the present invention will be described with reference to FIGS. 5 through 8. This embodiments provides a valve apparatus for driving a double-acting actuator. FIG. 5 is a vertical sectional view of the valve apparatus, and FIG. 6 is a circuit diagram showing the valve apparatus in terms of function. In these drawings, the identical components to those shown in FIG. 1 are denoted by the same reference numerals.

In FIGS. 5 and 6, a valve apparatus 5A of this embodiment comprises a block 6 forming a body, a flow control valve 8A having a spool 7 slidable in a spool bore 6*a* defined in the block 6, a pressure compensating valve 9 provided upstream of the flow control valve 8A to control differential pressure between inlet pressure Pz and outlet pressure PL of the flow control valve 8A, i.e., differential pressure Pz−PL across the flow control valve 8A, and a shuttle valve 10 provided downstream of the flow control valve 8A.

The block 6 has formed therein two supply passages 11*a*, 11*b* communicating with a hydraulic pump 1, two load passages 12*a*, 12*b* capable of communicating with the supply passages 11*a*, 11*b*, respectively, and connected to a hydraulic actuator shown in FIG. 6, e.g., a swing motor 4A for driving a swing of a hydraulic excavator, and two tank passages 13*a*, 13*b* capable of communicating with the load passages 12*a*, 12*b*, respectively. The spool 7 has two first meter-in variable restrictors 14*a*, 14*b* for communicating the supply passage 11*a* with the load passage 12*a* and communicating the supply passage 11*b* with the load passage 12*b*, respectively, and being opened dependent on the stroke of the spool 7, two detection ports 15*a*, 15*b* capable of being open to the load passages 12*a*, 12*b* downstream of the first variable restrictors 14*a*, 14*b*, respectively, to detect the load pressure PL of the swing motor 4A, two passages 16*a*, 16*b* communicating with the detection ports 15*a*, 15*b*, respectively, and two passages 17*a*, 17*b* communicating with the passages 16*a*, 16*b*, respectively. The block 6 further has a passage 18 capable of communicating with the passages 17*a*, 17*b*.

The spool 7 is also formed with a second variable restrictor 21*a* positioned between the passage 17*b* and the passage 18 and having its opening area variable dependent on the stroke of the spool 7 when the spool 7 is moved rightwardly on the drawing, a second variable restrictor 21*b* positioned between the passage 17*a* and the passage 18 and having its opening area variable dependent on the stroke of the spool 7 when the spool 7 is moved leftwardly on the drawing, a fixed restrictor 22*a* positioned between the passage 17*a* and the passage 18 and carrying out its function when the spool 7 is moved rightwardly on the drawing, and a fixed restrictor 22*b* positioned between the passage 17*b* and the passage 18 and carrying out its function when the spool 7 is moved leftwardly on the drawing.

As with the first embodiment, the second variable restrictors 21*a*, 21*b* are configured such that they are open at a predetermined opening when the spool 7 is in a neutral position, and are closed after opening of the first variable restrictors 14*a*, 14*b* when the spool stroke is increased.

The detection port 15*a*, the passages 16*a*, 17*a* and the passage 18 jointly constitute a first signal passage for detecting the load pressure of the swing motor 4A downstream of the first variable restrictor 14*a*, when the spool 7 is moved rightwardly on the drawing. The detection port 15*b*, the passages 16*b*, 17*b* and the passage 18 jointly constitute a first signal passage for detecting the load pressure of the swing motor 4A downstream of the first variable restrictor 14*b*, when the spool 7 is moved leftwardly on the drawing. Further, the detection port 15*b* and the passages 17*b*, 16*a* jointly constitute a discharge passage for communicating the first signal passage 15*a*, 16*a*, 17*a*, 18 established when the spool 7 is moved rightwardly on the drawing, with the tank passage 13*b*, the second variable restrictor 21*a*being disposed in this discharge passage. The detection port 15*a* and the passages 17*a*; 16*a* jointly constitute a discharge passage for communicating the first signal passage 15*b*, 16*b*, 17*b*, 18 established when the spool 7 is moved leftwardly on the drawing, with the tank passage 13*a*, the second variable restrictor 21*b* being disposed in this discharge passage.

The fixed restrictor 22*a* is disposed in the first signal passage 15*a*, 16*a*, 17*a*, 18 established when the spool 7 is moved rightwardly on the drawing, and serves as auxiliary restrictor means for reducing the load pressure detected by that first signal passage to create the control pressure PLX lower than the load pressure. The fixed restrictor 22*b* is disposed in the first signal passage 15*b*, 16*b*, 17*b*, 18 established when the spool 7 is moved leftwardly on the drawing, and serves as auxiliary restrictor means for reducing the load pressure detected by that first signal passage to create the control pressure PLX lower than the load pressure.

The control pressure PLX produced in the passage 18 constituting a part of the first signal passage is, similarly to the first embodiment, introduced to a signal line 19 as a second signal passage through the shuttle valve 10 as higher-pressure selector means, and used for the load sensing control by the pump regulator 2.

Figure 7A:
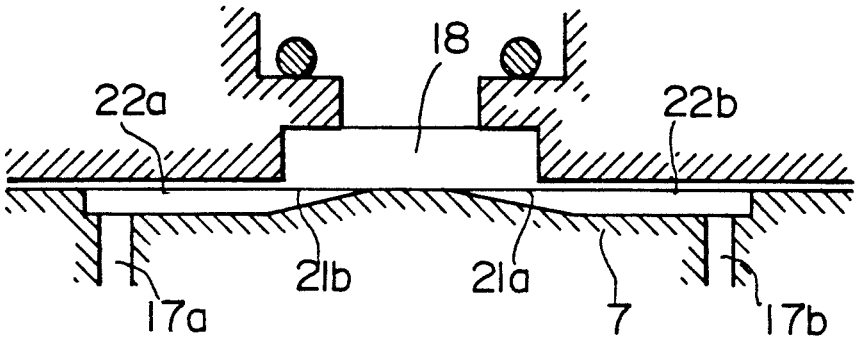
FIGS. 7(*a*) and 7(*b*) are detailed views of a second variable restrictor and a fixed restrictor provided in the valve apparatus shown in FIG. 5.
Figure 7B:
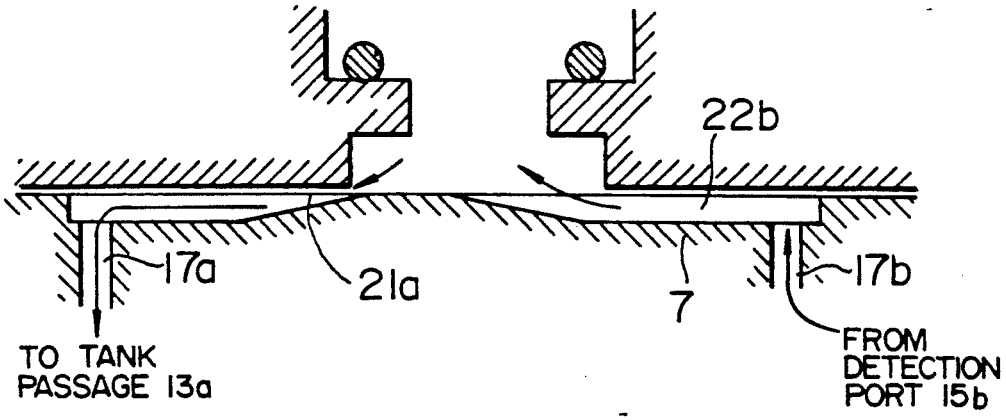

The second variable restrictors 21*a*, 21*b* and the fixed restrictors 22*a*, 22*b* are detailed in FIGS. 7(*a*) and 7(*b*). Of these drawings, FIG. 7(*a*) shows a neutral state of the spool 7, and FIG. 7(*b*) shows a state in which the spool 7 has been moved leftwardly. Arrows in FIG. 7(*b*) indicate a flow of the hydraulic fluid in the signal passage and the discharge passage.

Figure 8:
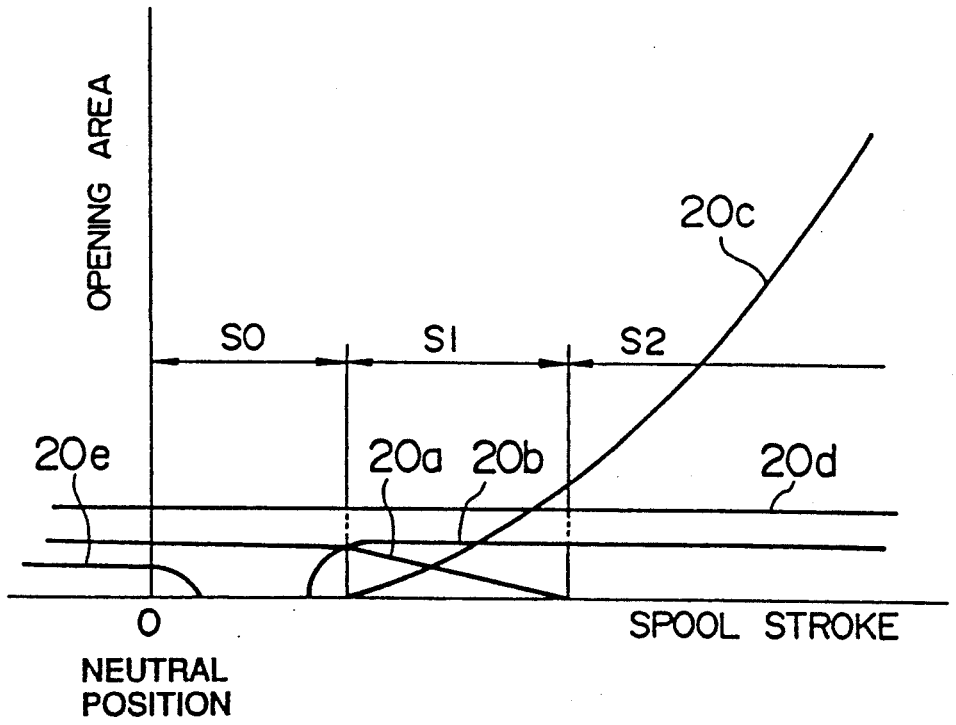
FIG. 8 is a characteristic view showing the relationships between the spool stroke of a flow control valve and the opening areas of a first variable restrictor, the second variable restrictor and the fixed restrictor as developed in the second embodiment shown in FIG. 5.

Shift timing of the first and second variable restrictors 14*a*, 14*b* and 21*a*, 21*b* and the detection ports 15*a*, 15*b* with respect to the spool stroke of the flow control valve 8A is shown in FIG. 8. Characteristics of the first variable restrictors 14*a*, 14*b*, i.e., the relations of their opening areas with respect to the stroke of the spool 7, are set identical to the characteristic line 20*c* in FIG. 3. Characteristics of the second variable restrictors 21*a*, 21*b* are set identical to the characteristic line 20*a* in FIG. 3. Characteristics of the fixed restrictors 22*a*, 22*b* are set identical to the characteristic line 20*d* in FIG. 3. The opening areas between the detection ports 15*a*, 15*b* and the load passages 12*a*, 12*b* are set identical to the characteristic line 20*b* in FIG. 3. In addition, the characteristic line 20*e* indicates the opening area between the detection ports 15*a*, 15*b* and the tank passages 13*a*, 13*b*.

The swing motor 4A is a double-acting actuator. In a main line connected to the load passages 12*a*, 12*b* of the valve apparatus 5A, there is disposed a counter balance valve 35 for blocking off the holding pressure produced when the swing (not shown) is installed on a slope.

With the second embodiment thus arranged, when the spool 7 is moved from a neutral position rightwardly in FIG. 5 with an intention of driving the swing motor 4A solely, the communication between the detection port 15*a* and the tank passage 13*a* is first cut of as seen from the characteristic line 20*e* in FIG. 8. When the spool 7 is further moved from the above condition, the first variable restrictors 14*a*, 14*b*, the second variable restrictors 21*a*, 21*b*, the fixed restrictors 22*a*, 22*b*, the detection ports 15*a*, 15*b*, and the load passages 12*a*, 12*b*, though each provided in pair, exhibit their characteristics identical to those in the foregoing first embodiment. Accordingly, the above-described equations (5) through (7) are also satisfied in the second embodiment. As a result, the port pressure, i.e., the drive pressure PL, and the delivery pressure Pd of the hydraulic pump 1 can be controlled dependent on the operation amount of the flow control valve 8A, i.e., the spool stroke, thereby providing the similar advantageous effect to that in the first embodiment.

Because the control pressure PLX created in the passage 18 through the fixed restrictors 22*a*, 22*b* meets the relationship of PL>PLX, the differential pressure $\Delta P = Pd - PLX$ between the pump delivery pressure Pd and the control pressure PLX can be a satisfactorily large value. Further, because the control pressure PLX is created using two restrictors; the fixed restrictor 22*a*, 22*b* and the second variable restrictor 21*a*, 21*b*, the flow rate of the hydraulic fluid passing from the detection port 15*a*, 15*b* as the signal passage to the tank passage 13*b*, 13*a* through the passage 18 and the detection port 15*b*, 15*a* as the discharge passage can be reduced, and the pressure control can be achieved with smaller energy loss. In this point, the similar advantageous effect to that in the first embodiment can also be obtained.

It is of course a matter that although the restrictors 22*a*, 22*b* are fixed ones in this embodiment, they may be variable ones whose openings are variable dependent on the stroke of the spool 7, as with the foregoing first embodiment.

Third Embodiment

A third embodiment of the present invention will be described with reference to FIG. 9. This embodiment is to give the valve apparatus with a function of reserving the holding pressure of the actuator.

Figure 9:
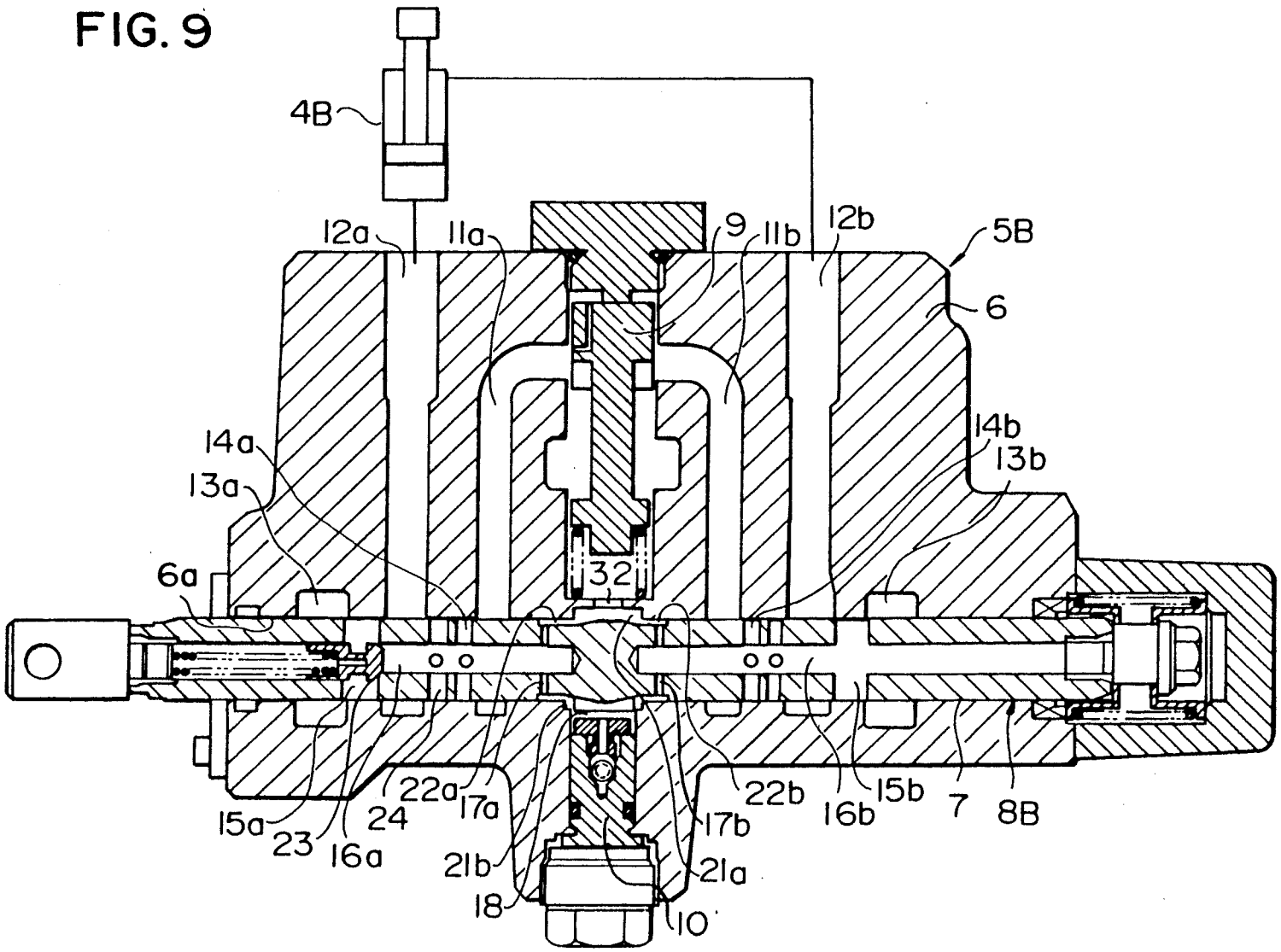
FIG. 9 is a vertical sectional view of a valve apparatus according to a third embodiment of the present invention.

In FIG. 9, a valve apparatus 5B of this embodiment has second variable restrictors 21*a*, 21*b* and fixed restrictors 22*a*, 22*b* identical to those in the foregoing second embodiment. A check valve 23 with small spring pressure is slidably fitted in a spool 7 which constitutes a flow control valve 8B. When the spool 7 is in the vicinity of a neutral position, the passage 16*a* is connected to the tank passage 13*a* through the check valve 23, thereby forming the discharge passage. When the spool 7 is moved rightwardly on the drawing, the fixed restrictor 22*a* functions between the detection port 15*a* and the passage 18, and the supply passage 11*a* is communicated with the load passage 12*a* through the check valve 23 upon opening of the first meter-in variable restrictor 14*a*. When the spool 7 is moved leftwardly on the drawing, the passage 18 is communicated with the tank passage 13*a* through the second variable restrictor 21*b*, the passage 17*a*, the passage 16*a* and the check valve 23 which jointly define the discharge passage.

Then, as an actuator of which operation is controlled by the valve apparatus 5B, there is provided a hydraulic cylinder, e.g., a boom cylinder 4B for driving a boom of hydraulic excavators. The boom cylinder 4B is communicated at the head side with the load passage 12*a* in which the check valve 23 is located, and at the rod side with the load passage 12*b*.

During operation of a boom (not shown) carried out by the boom cylinder 4B, for example, when the boom is held at an elevated level in air, the dead load of the boom acts on the boom cylinder 4B and the holding pressure is produced in the head side line of the boom cylinder 4B, i.e., the load passage 12*a*.

With the third embodiment thus arranged, when the spool 7 of the flow control valve 8B is moved rightwardly with an intention of driving the boom cylinder 4B solely, the detection port 15*a* is first disconnected from the tank passage 13*a*, and the detection port 15*a* is then communicated with the load passage 12*a*. Afterward, the passage 16*a* is communicated with the supply passage 11*a* through the first meter-in variable restrictor 14*a*. Consequently, the first variable restrictor 14*a*, the fixed restrictor 22*a* and the second variable restrictor 21*a* now constitute the foregoing hydraulic system shown in FIG. 4. As a result, the above-described equations (5) through (7) are also satisfied in the third embodiment, whereby the port pressure PL and the pump delivery pressure can be controlled dependent on the spool stroke of the flow control valve 8B as with the foregoing second embodiment. At this time, the hydraulic fluid is supplied from the supply passage 11*a* to the head side of the boom cylinder 4B through the first variable restrictor 14*a*, the passage 16*a*, the check valve 23 and the load passage 12*a*.

In this connection, if the aforesaid holding pressure is produced in the head side line of the boom cylinder 4B, i.e., the load passage 12*a*, the pressure in the passage 16*a* is determined by the stroke of the spool within the stroke range where the hydraulic system shown in FIG. 4 is established, and that pressure may be lower than the holding pressure produced in the load passage 12*a*. To cope with that, in this embodiment, the check valve 23 acts to prevent the hydraulic fluid from flowing from the load passage 12*a* the passage 16*a*. Therefore, even if the holding pressure is produced in the head side line of the boom cylinder 4B, i.e., the load passage 12*a*, the hydraulic fluid under pressure held in the load passage 12*a* will not flow into the passage 16*a* and then flow out to the reservoir tank through the fixed restrictor 22*a*, the passage 18, the second variable restrictor 21*a*, and the discharge passage which is defined by the passages 17*b*, 16*b* and the detection port 15*b*. Consequently, this embodiment can reserve a holding function to prevent contraction of the boom cylinder 4B, i.e., a drop of the boom by the gravity or dead load.

On the contrary, when the spool 7 of the flow control valve 8 is moved leftwardly, the supply passage 11*b* is communicated with the load passage 12*b* in which no holding pressure occurs, through the first meter-in variable restrictor 14*b* and the passage 16*b*. Also, the second variable restrictor 21*a*, the passages 17*a*, 16*a*, the check valve 23 and the detection port 15*a* jointly define the discharge passage led to the tank passage 13*a*. In this embodiment, therefore, since the hydraulic system shown in FIG. 4 is established by the fixed restrictor 22*b* and the second variable restrictor 21*b*, the foregoing equation (5) through (7) are satisfied and the port pressure PL and the pump delivery pressure can be controlled desirably. At this time, the returning hydraulic fluid on the head side of the boom cylinder 4B is discharged from the load passage 12*a* to the tank passage 13*a* through the passages 24, 16*a* and the check valve 23.

Thus, with satisfaction of the foregoing equations (5) through (7), the third embodiment can control the port pressure (drive pressure) PL and the pump delivery pressure dependent on the spool stroke of the flow control valve 8B, and can achieve force control for regulating thrust of the boom cylinder 4B with the control of the port pressure.

In addition, since the third embodiment includes the check valve 23 between the load passage 12*a* and the first variable restrictor 14*a*, when the spool 7 shown in FIG. 9 is moved rightwardly to extend the boom cylinder 4B, the hydraulic fluid held under pressure on the head side of the boom cylinder 4B will not flow into the passage 16*a*, and the boom (not shown) can be prevented from dropping by the dead load upon contraction of the boom cylinder 4B.

Fourth Embodiment

A fourth embodiment of the present invention will be described with reference to FIGS. 10 and 11. This embodiment is to provide a valve apparatus for use in a double-acting actuator which has no counter balance valve.

Figure 10:
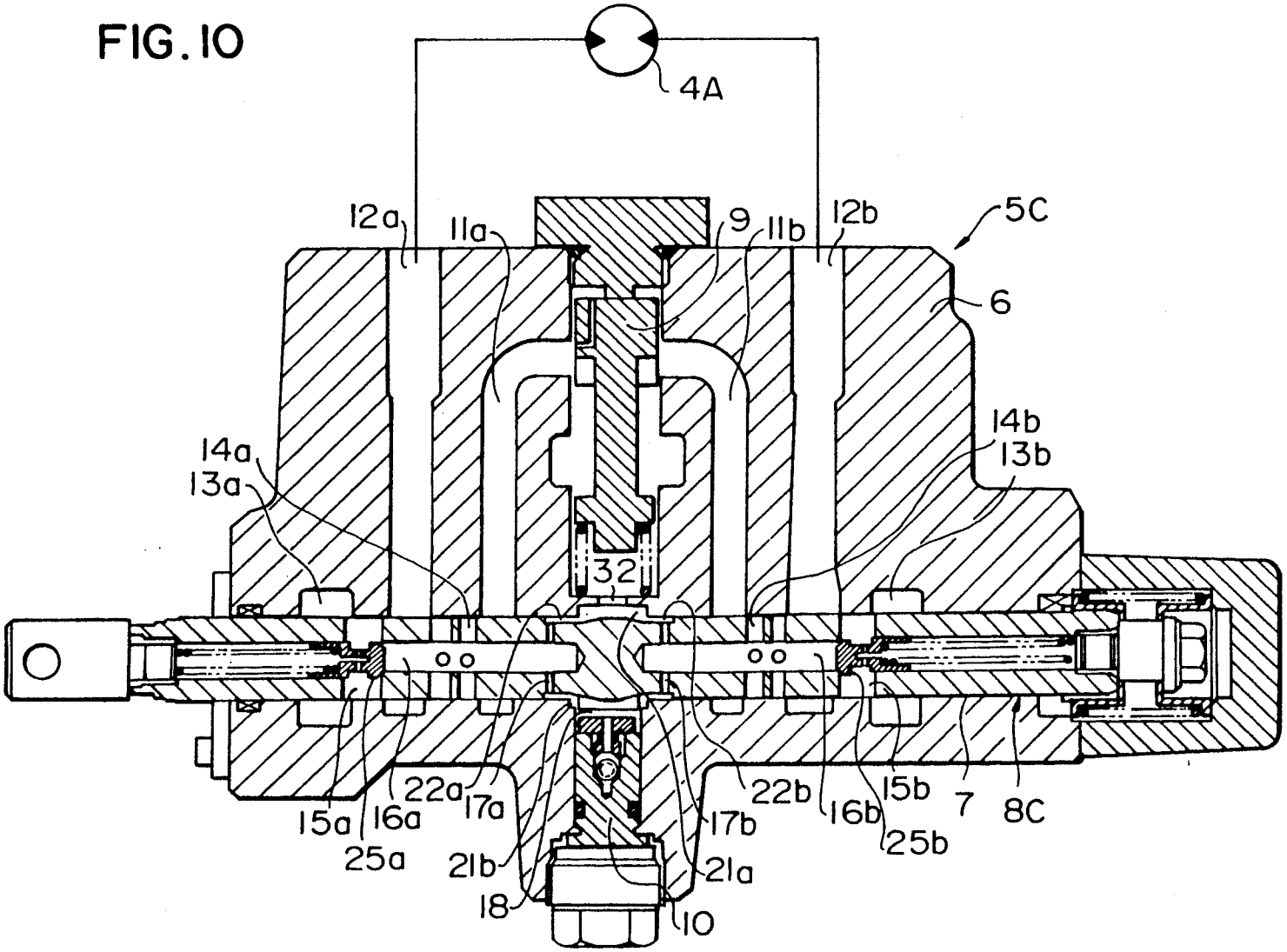
FIG. 10 is a vertical sectional view of a valve apparatus according to a fourth embodiment of the present invention.

In FIG. 10, a valve apparatus 5C includes a pair of check valves 25*a*, 25*b* disposed in a spool 7 of the flow control valve 8C. The check valve 25*a* is disposed between the supply passage 11*a* and the load passage 12*a* as well as the tank passage 13*a*, while the check valve 25*b* is disposed between the supply passage 11*b* and the load passage 12*b* as well as the tank passage 13*b*. A swing motor 4A having no counter balance valve is provided as an actuator to drive a swing (not shown).

Figure 11:
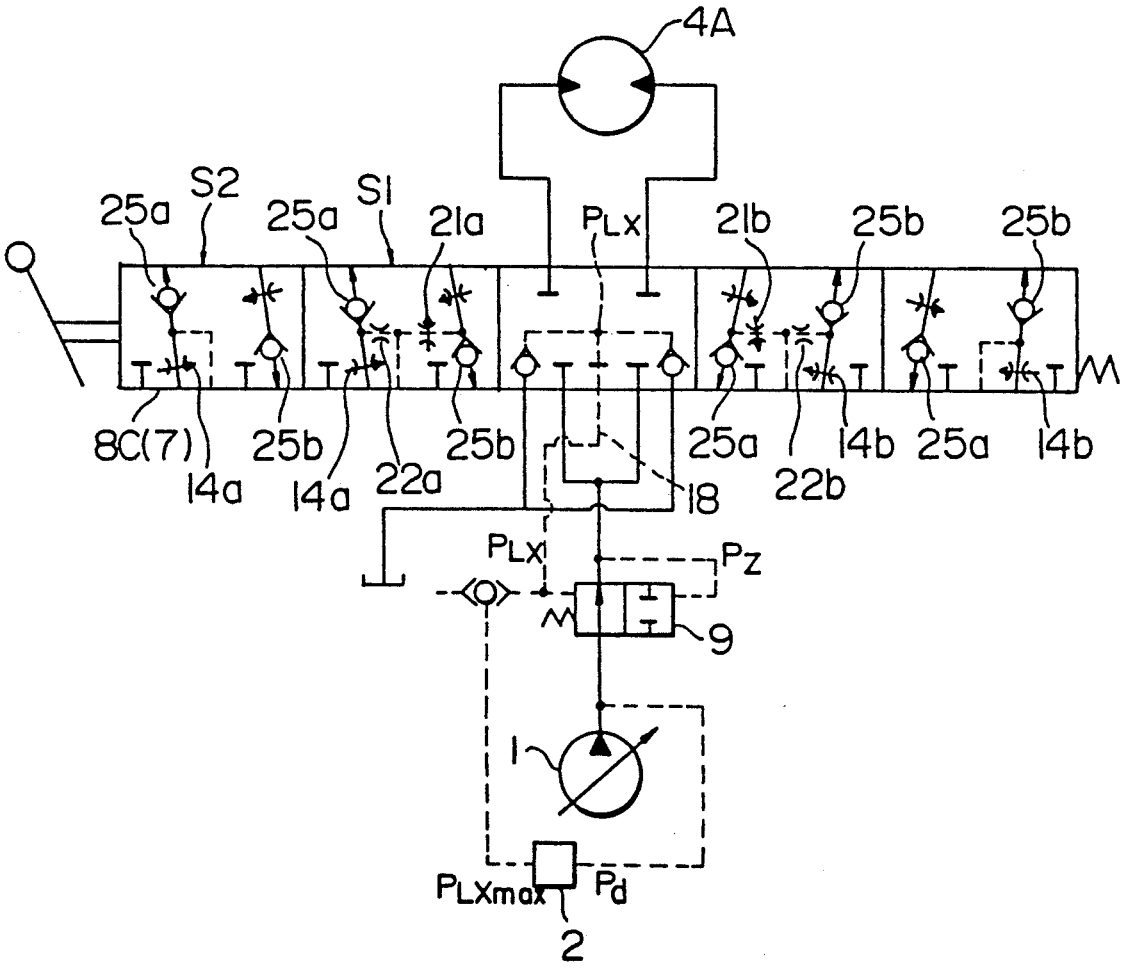
FIG. 11 is a circuit diagram showing the valve apparatus shown in FIG. 10 in terms of function.

The spool 7 of the flow control valve 8C is depicted as shown in FIG. 11 in terms of function. When the spool 7 is moved rightwardly from the condition shown in FIG. 11, a region S1 of this spool 7 corresponds to the aforesaid region S1 in FIG. 8, i.e., the stroke region where the fixed restrictor 22*a* and the second variable restrictor 21*a* both function as restrictors. Also, a region S2 of the spool 7 shown in FIG. 11 corresponds to the aforesaid region S2 in FIG. 8, i.e., the stroke region where the second variable restrictor 21*a* is closed. The remaining structure of the valve apparatus 5C is identical to that shown in FIG. 9.

With the fourth embodiment thus arranged, when the spool 7 of the flow control valve 8C is moved rightwardly in FIGS. 10 and 11, for example, the hydraulic system shown in FIG. 4, which includes the first variable restrictor 14*a*, the fixed restrictor 22*a*, and the discharge passage having the second variable restrictor 21*a* and the check valve 25 therein, is established in a range of the region S1 shown in FIG. 11. Therefore, the foregoing equations (5) through (7) are satisfied and the port pressure PL can be controlled dependent on the stroke of the spool 7, i.e., the lever operation amount of the flow control valve 8C in any operation of driving the swing motor solely or in combination with other one or more actuators. This is equally applied to the case where the spool 7 is moved leftwardly in FIGS. 10 and 11. As a result, the similar advantageous effect to that in the foregoing second embodiment can be obtained.

Furthermore, if the swing (not shown) is installed on a slope, for example, the holding pressure is produced in either the load passage 12*a* or 12*b* both connected to the swing motor 4A. In such a case, when the spool 7 of the flow control valve 8C is moved, the hydraulic system shown in FIG. 4 is established in a range of the region S1 shown in FIG. 11 as mentioned above, and the pressure in the passage 16*a* or 16*b* is determined by the stroke of the spool 7, resulting in that the pressure in the passage 16*a* or 16*b* may be lower than the holding pressure produced in the load passage 12*a*, 12*b*. With this fourth embodiment, however, no matter which one of the load passages 12*a*, 12*b* is subjected to the holding pressure, the hydraulic fluid held in the load passage under pressure is prevented from flowing into the supply passage 11*a*, 11*b* by the corresponding one of the check valves 25*a*, 25*b*. This ensures it to avoid operation of the swing motor 4A not intended by the operator, i.e., undesired motion of the swing (not shown).

Fifth Embodiment

A fifth embodiment of the present invention will be described with reference to FIG. 12. This embodiment has an operator check, in place of the check valve, to block off the holding pressure.

Figure 12:
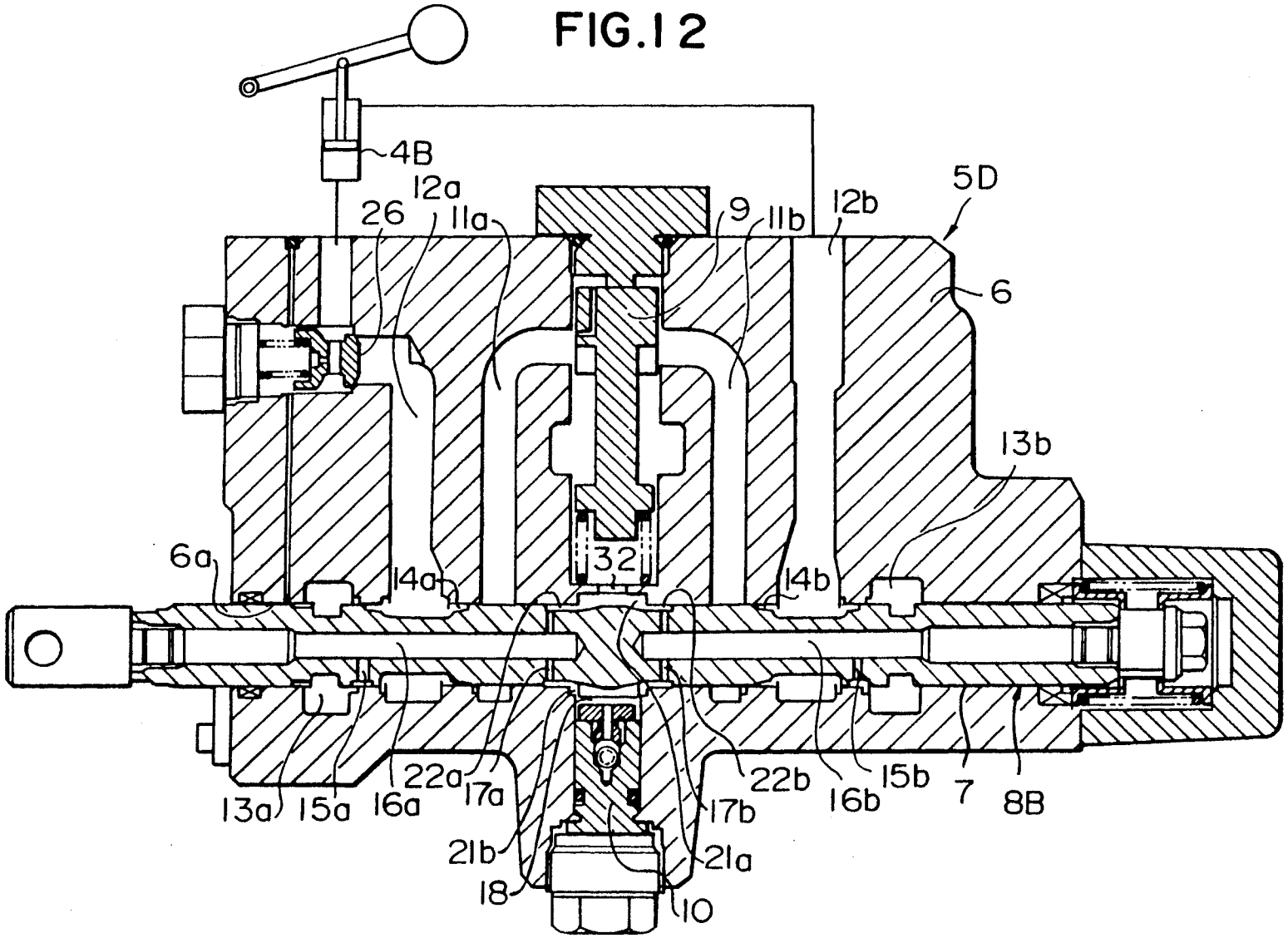
FIG. 12 is a vertical sectional view of a valve apparatus according to a fifth embodiment of the present invention.

In FIG. 12, a valve apparatus 5D of this embodiment has an operator check 26 in a load passage 12*a* which is defined in a block 6 constituting the valve apparatus body and is subjected to the holding pressure of a boom cylinder 4B. The remaining structure is identical to that of the second embodiment shown in FIG. 5.

With this fifth embodiment thus arranged, the foregoing equations (5) through (7) are satisfied on the basis of the hydraulic system including the first variable restrictors 14*a*, 14*b*, as well as the corresponding fixed restrictors 22*a*, 22*b* and the second variable restrictors 21*a*, 21*b*. Therefore, the port pressure PL and the pump delivery pressure can be controlled dependent on the lever operation amount of the flow control valve 8B. In addition, when the hydraulic fluid is supplied to the load passage 12*a* to extend the boom cylinder 4B, the operator check 26 is opened only after the pressure in the load passage 12*a* becomes larger than the holding pressure acting on the head side of the boom cylinder 4B, allowing the hydraulic fluid to be supplied to the head side of the boom cylinder 4B for driving of the boom cylinder 4B. Consequently, the hydraulic fluid boosted in pressure for holding the boom cylinder 4B is prevented from flowing into the supply passage 11*a*, and the similar advantageous effect to that in the third embodiment of FIG. 9 can be obtained.

Sixth Embodiment

Figure 13:
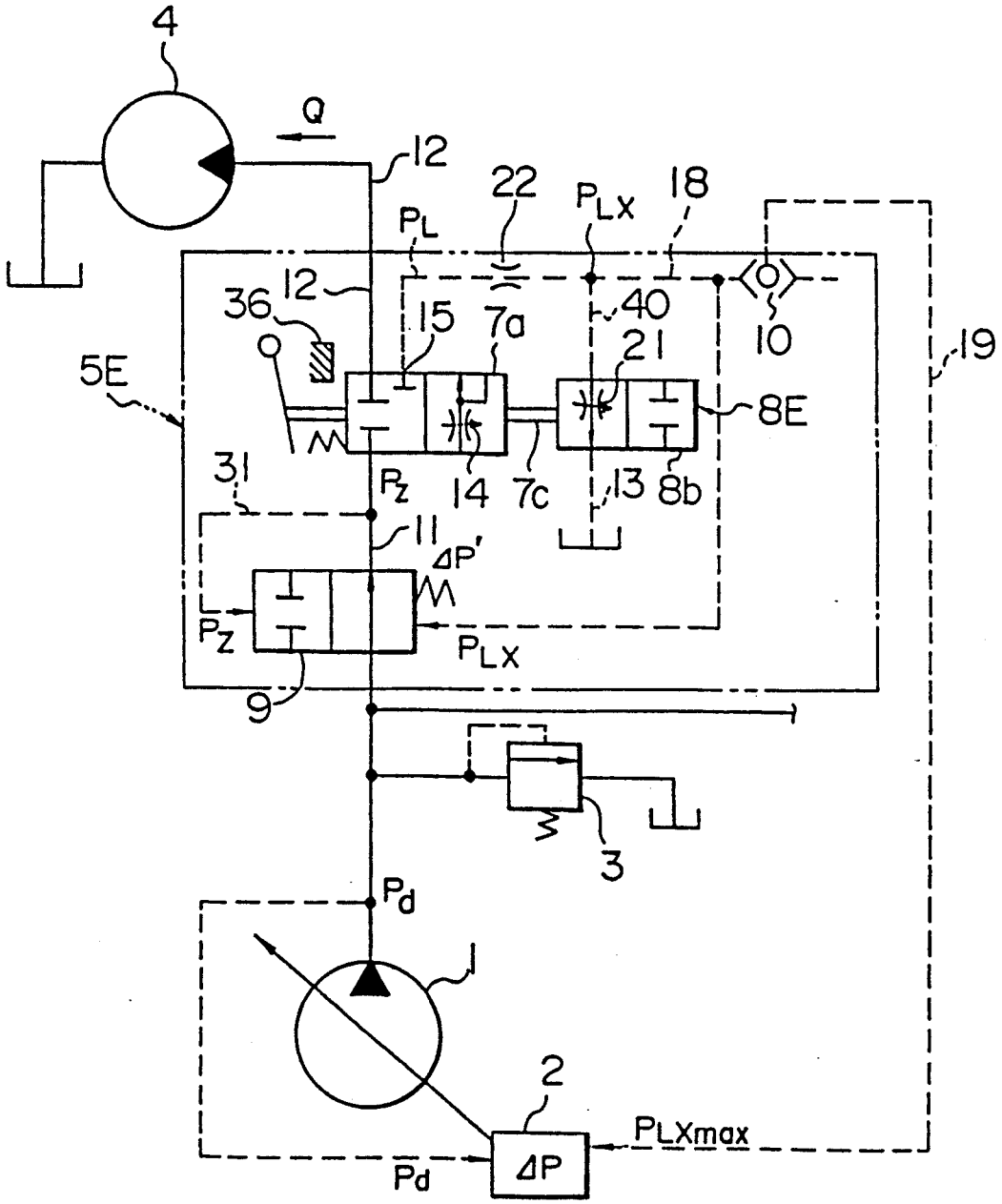
FIG. 13 is a schematic view of a hydraulic drive system incorporating a valve apparatus according to a sixth embodiment of the present invention.

A sixth embodiment of the present invention will be described with reference to FIG. 13. A valve apparatus 5E according to the sixth embodiment, shown in FIG. 13, has a limited 36 for limiting the operation amount of a flow control valve 8E to a predetermined amount in short of the maximum stroke, in addition to the structure of the foregoing first embodiment shown in FIG. 1. The limiter 36 comprises, for example, a projection against which a spool section 7*a* of the flow control valve 8E strikes for restriction of its movement. A maximum value of the stroke restricted by the limiter 36 corresponds to a point X contained in the region S1 of FIG. 3 by way of example.

The sixth embodiment thus arranged is effective in the case where the inertial load to be driven by the hydraulic motor 4 is relatively small and, therefore, the load pressure is small. The installed position of the limiter 36 is previously set such that when the flow control valve 8E is operated until the spool section 7*a* strikes against the limiter 36, the load pressure PL determined by the foregoing equations (5) through (7) has a value substantially in agreement with the drive pressure necessary for the hydraulic motor 4. With such presetting, the maximum port pressure is determined from the above equation (6), and the load pressure applied to the hydraulic motor is limited to the relatively small load pressure PL corresponding to the point X in FIG. 3.

Accordingly, with this sixth embodiment, since the basic structure is identical to that of the foregoing first embodiment, the aforesaid equations (5) through (7) are satisfied, whereby the flow rate and the load pressure PL can be controlled as intended by the operator. In addition, without the need of especially installing a relief valve adapted to release the surplus load pressure produced in a circuit containing the hydraulic motor 4, it is possible to protect equipment in that circuit from damage, and to suppress energy loss which would otherwise be caused with release of the surplus load pressure, resulting in an advantage of economy.

Seventh Embodiment

Figure 14:
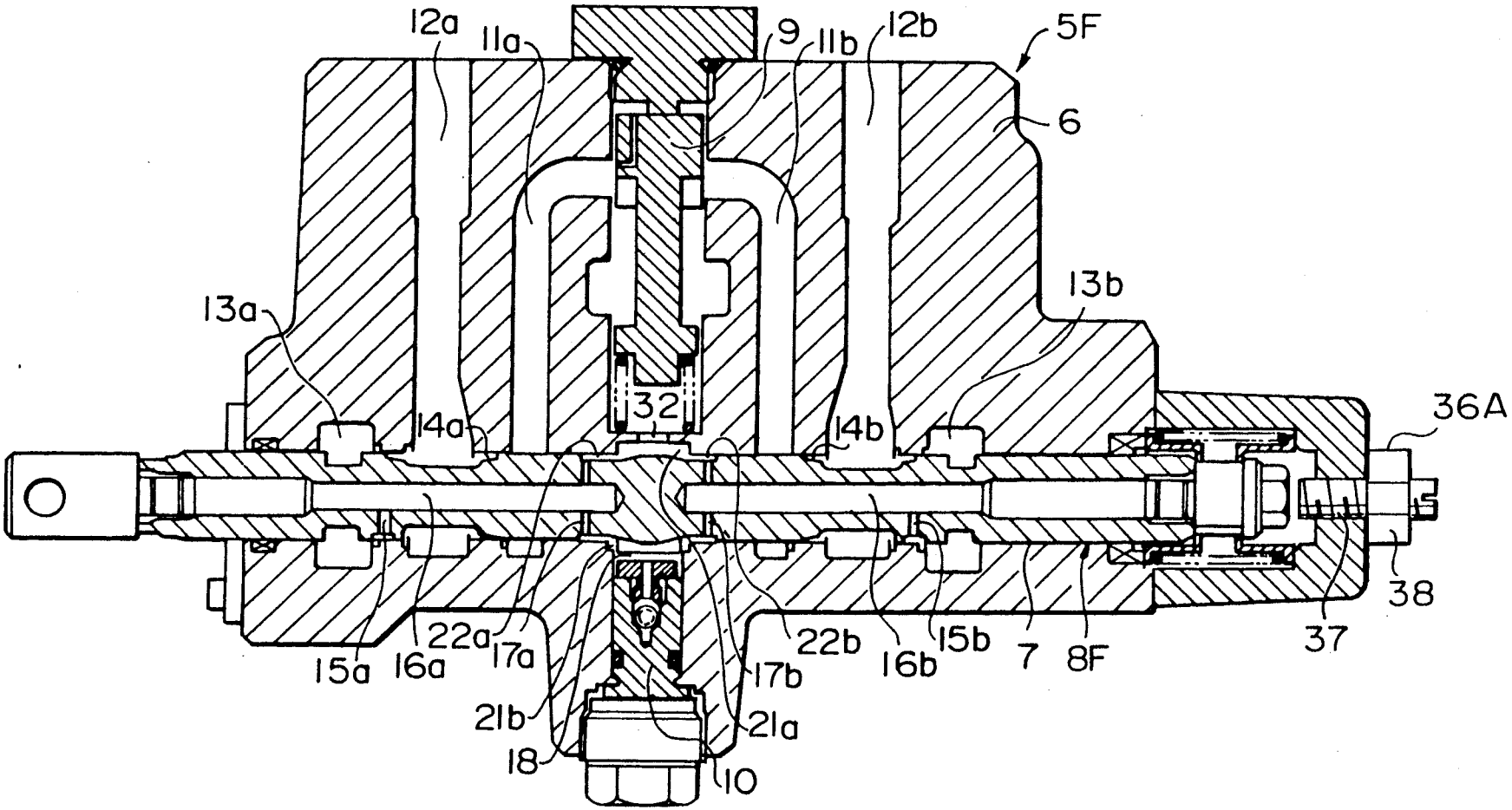
FIG. 14 is a vertical sectional view of a valve apparatus according to a seventh embodiment of the present invention.

A seventh embodiment of the present invention will be described with reference to FIG. 14. A valve apparatus 5F according to the seventh embodiment, shown in FIG. 14, has a limiter 36A in addition to the structure of the foregoing second embodiment shown in FIG. 5. The limiter 36A comprises a screw 37 for limiting the stroke of a spool 7 of a flow control valve 8F to a predetermined position in short of the maximum stroke, and a lock nut 38 for fastening the screw 37 in place.

As with the foregoing sixth embodiment, this seventh embodiment can also limit the drive pressure of the actuator to be controlled by the valve apparatus 5F, and provide the similar advantageous effect to that in the sixth embodiment.

Eighth Embodiment

Figure 15:
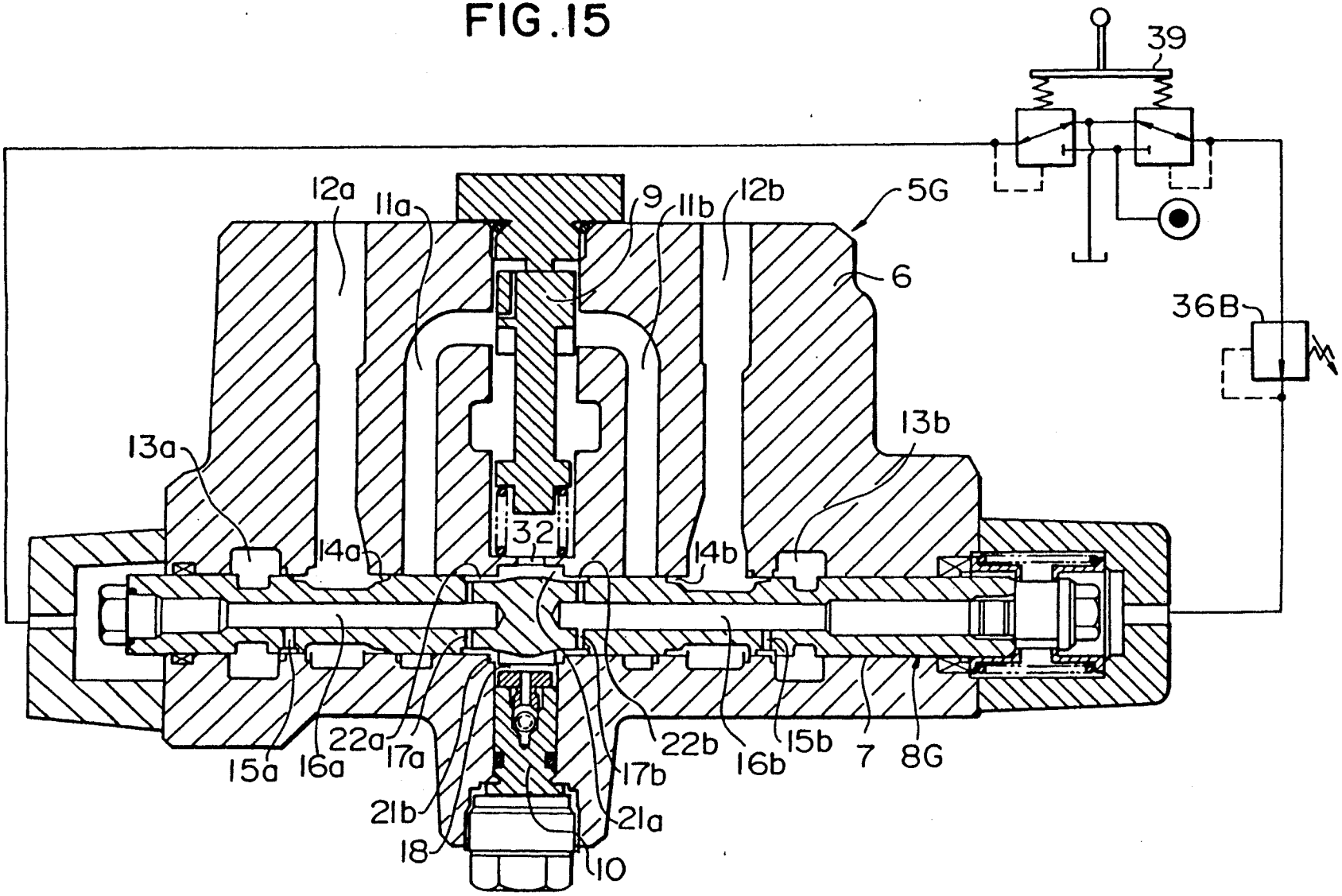
FIG. 15 is a vertical sectional view of a valve apparatus according to an eighth embodiment of the present invention.

An eighth embodiment of the present invention will be described with reference to FIG. 15. A valve apparatus 5G according to the eighth embodiment has a pilot valve 39 and a pressure reducing valve 36B for reducing pilot pressure generated by the pilot valve 39. The pressure reducing valve 36B serves as a limiter for limiting the operation amount of a spool 7 of a flow control valve 8G. The remaining structure is identical to that of the foregoing second embodiment shown in FIG. 5.

Thus, by adjusting the pilot pressure, it is also possible to achieve the similar operation to that in the foregoing seventh embodiment, and to provide the similar advantageous effect to that in the seventh embodiment.

With the pressure reducing valve 36B as a limiter being in the form of a solenoid proportional valve, the maximum pilot pressure, i.e., the maximum stroke, can be adjusted using an electric signal.

Industrial Applicability

According to the present invention, when the flow control valve is operated from a neutral position in the sole or combined operation of one or more actuators, the delivery pressure of the hydraulic pump and the drive pressure of the actuator can be controlled dependent on the operation amount of the flow control valve. This reliably eliminates the event that the pump delivery pressure may be increased up to the setting pressure of a main relief valve against the intention of an operator, and ensures excellent operability. Also, the control of the drive pressure permits force control of the actuator so that, when the actuator drives an inertial load, an acceleration of the inertial load may be controlled. As a result, the shock perceived by the operator can be alleviated.

Further, since the load pressure is reduced by a fixed restrictor to create the control pressure, the differential pressure between the pump delivery pressure and the control pressure can be set to a satisfactorily large value to thereby enable the loading sensing control of the hydraulic pump free from hunting. In addition, since the control pressure is created using two restrictors; i.e., the fixed restrictor and the second variable restrictor, the flow rate of the hydraulic fluid flowing from the signal passage to the reservoir tank through the discharge passage can be reduced so as to achieve the pressure control with small energy loss.

What is claimed is:

1. A valve apparatus for controlling a flow of a hydraulic fluid supplied from a hydraulic fluid supply source to an actuator, comprising a flow control valve having a supply passage communicating with said hydraulic fluid supply source, a load passage; communicating with said actuator, and a first meter-in variable restrictor disposed between said supply passage and said load passage and opened dependent on an operation amount thereof; a first signal passage located downstream of said first variable restrictor and having a passage section for detecting load pressure of said actuator; a tank passage communicating with a reservoir tank; a discharge passage for communicating said first signal passage with said tank passage; and a second variable restrictor provided in said discharge passage and having its opening variable dependent on the operation amount of said flow control valve to produce in said first signal passage a control pressure different from said load pressure, the control pressure in said first signal passage being led to said hydraulic fluid supply source through a second signal passage, wherein:

said valve apparatus further comprises auxiliary restrictor means disposed in said first signal passage for reducing the load pressure detected in said passage section of said first signal passage so that a pressure lower than the detected load pressure is produced in said first signal passage as said control pressure.

2. A valve apparatus according to claim 1, wherein said second variable restrictor is configured to be open to a predetermined opening when said flow control valve is in a neutral position, and closed after opening of said first variable restrictor when said flow control valve is operated.

3. A valve apparatus according to claim 1, further comprising higher-pressure selector means for selecting a maximum one of control pressures including the control pressure produced in said first signal passage, and leading the selected maximum pressure as the control pressure to said second signal passage.

4. A valve apparatus according to claim 1, further comprising a pressure compensating valve for controlling a differential pressure across said first variable restrictor, and a third signal passage for leading the control pressure produced in said first signal passage to said pressure compensating valve, wherein said pressure compensating valve holds a differential pressure between an inlet pressure of said first variable restrictor and the control pressure in said first signal passage at a predetermined value to thereby control the differential pressure across said first variable restrictor.

5. A valve apparatus according to claim 1, wherein said flow control valve has a spool movable in its axial direction, and said first variable restrictor, said second variable restrictor and said auxiliary restrictor means are formed in said spool.

6. A valve apparatus according to claim 1, wherein a check valve is disposed between said first variable restrictor and said load passage for allowing the hydraulic fluid to flow only in a direction toward said load passage from said first variable restrictor.

7. A valve apparatus according to claim 1, wherein an operator check is disposed in said load passage.

8. A valve apparatus according to claim 1, further comprising limiter means for limiting the operation amount of said flow control valve to a predetermined value.

9. A valve apparatus for controlling a flow of hydraulic fluid supplied from a hydraulic fluid supply source to a double-acting actuator, comprising a flow control valve having supply passages communicating with said hydraulic fluid supply source, a pair of load passages communicating with said actuator, and a pair of first meter-in variable restrictors disposed between said supply passages and said pair of load passages, respectively, and opened alternatively dependent on the operating direction to an opening dependent on an operation amount thereof; a pair of first signal passages located downstream of said pair of first variable restrictors, respectively, and having passage sections for detecting load pressure of said actuator alternatively dependent on the operating direction; a pair of tank passages each communicating with a reservoir tank; a pair of discharge passages for communicating said pair of first signal passages with said pair of tank passages, respectively; and a pair of second variable restrictors provided in said pair of discharge passages, respectively, and having their openings variable dependent on the operation amount of said flow control valve to produce in said pair of first signal passages a control pressure different from the load pressure detected in the corresponding first signal passage, alternatively dependent on the operating direction, the control pressure produced alternatively in said pair of first signal passages being led to said hydraulic fluid supply source through a second signal passage, wherein:

said valve apparatus further comprises a pair of auxiliary restrictor means disposed in said pair of first signal passages, respectively, for reducing the load pressure detected alternatively in said passage sections of said pair of first signal passages so that a pressure lower than the detected load pressure is produced in the corresponding first signal passage as said control pressure.

10. A valve apparatus according to claim 9, wherein said flow control valve has a spool movable in its axial direction, and said pair of first variable restrictors, said pair of second variable restrictors and said pair of auxiliary restrictor means are formed in said spool.

11. A valve apparatus according to claim 10, wherein said spool has a pair of inner passages, one of said pair of inner passages functioning as one of said pair of first signal passages and the other of said pair of inner passages functioning as one of said pair of discharge passages when one of said pair of first variable restrictors is opened upon said spool axially moving in one direction, one of said pair of inner passages functioning as the other of said pair of discharge passages and the other of said pair of inner passages functioning as the other of said pair of first signal passages when the other of said pair of first variable restrictors is opened upon said spool axially moving in the other direction.

12. A valve apparatus according to claim 11, wherein said pair of inner passages have first passage sections positioned downstream of said pair of first variable restrictors and second passage sections capable of communicating said pair of load passages with said pair of tank passages, respectively, and wherein check valves are disposed between said first passage sections and said second passage sections, respectively, for allowing the hydraulic fluid to flow only in a direction toward said second passage sections from said first passage sections.

13. A hydraulic drive system comprising a hydraulic fluid supply source, at least one actuator driven by a hydraulic fluid from said hydraulic fluid supply source, and a valve apparatus for controlling a flow of the hydraulic fluid supplied from said hydraulic fluid supply source to said actuator, said valve apparatus comprising a flow control valve having a supply passage communicating with said hydraulic fluid supply source, a load passage communicating with said actuator, and a first meter-in variable restrictor disposed between said supply passage and said load passage and opened dependent on an operation amount thereof; a first signal passage located downstream of said first variable restrictor and having a passage section for detecting a load pressure of said actuator; a tank passage communicating with a reservoir tank; a discharge passage for communicating said first signal passage with said tank passage; a second variable restrictor provided in said discharge passage and having its opening variable dependent on the operation amount of said flow control valve to produce in said first signal passage a control pressure different from said load pressure; and a second signal passage for leading the control pressure in said first signal passage to said hydraulic fluid supply source, wherein:

said valve apparatus further comprises auxiliary restrictor means disposed in said first signal passage for reducing the load pressure detected in said passage section of said first signal passage so that a pressure lower than the detected load pressure is produced in said first signal passage as said control pressure.

14. A hydraulic drive system according to claim 13, wherein said hydraulic fluid supply source has a hydraulic pump and pump control means for controlling a delivery rate of said hydraulic pump such that a differential pressure between a delivery pressure of said hydraulic pump and the control pressure led through said second signal passage is held substantially constant.

15. A hydraulic drive system according to claim 13, further comprising a pressure compensating valve for controlling a differential pressure across said first variable restrictor, and a third signal passage for leading the control pressure produced in said first signal passage to said pressure compensating valve, wherein said pressure compensating valve holds a differential pressure between an inlet pressure of said first variable restrictor and the control pressure in said first signal passage at a predetermined value to thereby control the differential pressure across said first variable restrictor.

* * * * *